US009155950B2

(12) United States Patent
Fernandez et al.

(10) Patent No.: US 9,155,950 B2
(45) Date of Patent: Oct. 13, 2015

(54) WEIGHTED FLAG AND TARGET APPARATUS FOR USE IN A TOSS GAME

(71) Applicant: LEE HOUSE, LLC, Pittsford, NY (US)

(72) Inventors: William Wayne Fernandez, Pittsford, NY (US); Ethan David Sloan, Cumming, GA (US)

(73) Assignee: Lee House, LLC, Pittsford, NY (US)

( * ) Notice: Subject to any disclaimer, the term of this patent is extended or adjusted under 35 U.S.C. 154(b) by 163 days.

(21) Appl. No.: 13/661,621

(22) Filed: Oct. 26, 2012

(65) Prior Publication Data

US 2013/0109513 A1 May 2, 2013

Related U.S. Application Data

(60) Provisional application No. 61/551,865, filed on Oct. 26, 2011.

(51) Int. Cl.

| | |
|---|---|
| ***A63B 69/00*** | (2006.01) |
| ***A63B 67/06*** | (2006.01) |
| *A63B 63/00* | (2006.01) |

(52) U.S. Cl.

CPC ..... *A63B 67/06* (2013.01); *A63B 63/00* (2013.01); *A63B 2208/12* (2013.01); *A63B 2209/00* (2013.01); *A63B 2209/10* (2013.01); *Y10T 29/49826* (2015.01)

(58) Field of Classification Search

USPC ..... 473/422, 446, 451, 457, 458, 576; 124/21; 220/9.4; 273/391, 392; D21/303, 304

See application file for complete search history.

(56) References Cited

U.S. PATENT DOCUMENTS

| | | | | | |
|---|---|---|---|---|---|
| 715,249 | A | * | 12/1902 | Dunbar | 273/401 |
| 1,245,256 | A | * | 11/1917 | Miller | 220/9.4 |
| 2,302,845 | A | * | 11/1942 | Emerson | 473/580 |
| 3,126,933 | A | * | 3/1964 | Mason et al. | 383/33 |
| 3,269,673 | A | * | 8/1966 | Reiniger | 244/218 |
| 3,393,911 | A | * | 7/1968 | Lawson | 473/576 |
| 3,506,266 | A | * | 4/1970 | Wintersteen | 273/392 |
| 4,705,246 | A | * | 11/1987 | Wolf | 248/97 |
| 4,826,179 | A | | 5/1989 | Callaghan | |
| D317,191 | S | | 5/1991 | Williams et al. | |
| 5,112,023 | A | * | 5/1992 | Sowers | 248/519 |
| 5,112,061 | A | * | 5/1992 | Lamle | 473/473 |
| 5,115,343 | A | | 5/1992 | Bennett | |

(Continued)

OTHER PUBLICATIONS

Webpage download, wikihow2007, 2007, //web.archive.org/web/20070619022025/http://www.wikihow.com/Make-Referee-Penalty-Flags, 7 pages.*

(Continued)

*Primary Examiner* — Gene Kim
*Assistant Examiner* — M Chambers
(74) *Attorney, Agent, or Firm* — Heslin Rothenberg Farley & Mesiti P.C.; Andrew K. Gonsalves, Esq.

(57) ABSTRACT

The present invention relates to a weighted flag for use as an aerodynamic projectile directed to a target, an apparatus for receiving and storing a tossable object, and a toss game set that includes at least one weighted flag and at least one target apparatus according to the present invention. The present invention also relates to methods of making and using the weighted flag and target apparatus according to the present invention. The present invention further relates to a method of play that involves using the weighted flag and the target apparatus according to the present invention.

36 Claims, 26 Drawing Sheets

(56) References Cited

U.S. PATENT DOCUMENTS

| | | | | |
|---|---|---|---|---|
| 5,186,119 | A | 2/1993 | Hlavin | |
| 5,382,028 | A | 1/1995 | Sciandra et al. | |
| 5,706,756 | A | 1/1998 | Cunningham et al. | |
| D456,742 | S | 5/2002 | Williams | |
| 7,066,647 | B2 * | 6/2006 | Peska | 383/40 |
| D578,585 | S * | 10/2008 | Bramble et al. | D21/698 |
| D586,837 | S | 2/2009 | McCoin | |
| D600,864 | S * | 9/2009 | Lapin | D30/160 |
| D643,330 | S | 8/2011 | Tooker | |
| D712,485 | S * | 9/2014 | Fernandez et al. | D21/385 |
| 2004/0159280 | A1 | 8/2004 | Mohelsky et al. | |
| 2006/0099057 | A1 * | 5/2006 | Fair | 414/408 |
| 2013/0109513 | A1 * | 5/2013 | Fernandez et al. | 473/585 |

OTHER PUBLICATIONS

Webpage download, esty, Date unknown,etsy.com/listing/96445056/vintage-fabric-yo-yo-round-quilt-pieces , 2 pages.*

* cited by examiner

36

WEIGHTED FLAG AND TARGET APPARATUS FOR USE IN A TOSS GAME

CROSS-REFERENCE TO RELATED APPLICATIONS

This application claims priority benefit of U.S. Provisional Patent Application Ser. No. 61/551,865, filed Oct. 26, 2011, the disclosure of which is hereby incorporated by reference herein in its entirety.

FIELD OF THE INVENTION

The present invention relates to a weighted flag and a target apparatus for use in a toss game. The present invention also relates to a toss game set and associated methods of making and using the toss game set.

BACKGROUND OF THE INVENTION

In general, recreational toss games are not well-suited for both indoor and outdoor play. Further, most recreational toss games have at least one deficiency that affects its portability, flexibility of use, durability, and acceptable age of player. For example, a number of popular toss games are cumbersome to carry around, which is often due to the overall bulk and weight of the game set (e.g., Bocce ball, Horseshoes, Cornhole, etc.). Some toss games can only be played in specific areas (e.g., outdoors or indoors only) or terrains. For example, Bocce ball cannot be played on pavement or other hard, abrasive surfaces without scuffing or otherwise damaging the balls, and Horseshoes requires a pair of stakes to be immobilized in the ground. Further, even though Horseshoes and Bocce balls are designed to be played outdoors, they can damage a lawn. Lawn dart games must be played outdoors and are inherently dangerous to the players and observers of the game. Other toss games that are not easily portable due to bulk and weight, require game pieces that are not readily packable into their targets, while others include game pieces that can damage playing surfaces and that can themselves be damaged by particular playing surfaces. While various toss games are directed toward a particular age group, some toss games are not meant for all ages. For example, some toss games that require heavy tossing objects (e.g., Horseshoes) or that involve potentially dangerous tossing objects (e.g., lawn darts) are not suitable for the younger player.

Other deficiencies of current recreational toss games relate to the unpredictability of the tossing object, whether during the flight of the tossing object in the air or upon its landing. This unpredictability can leave the outcome of the game to chance rather than to skill. Another deficiency of current toss games relates to the lack of the target as being useful as a means for storing the tossing objects. Yet another deficiency in the toss game field is the lack of targets as being useful as memorabilia or as a decorative object for display while not in use in their related toss games.

The present invention is directed to addressing these and other deficiencies in the art.

SUMMARY OF THE INVENTION

The present invention relates to a weighted flag and a target apparatus for use in a toss game. The present invention also relates to a toss game set and associated methods of making and using the toss game set.

In one aspect, the present invention provides a weighted flag for use as an aerodynamic projectile directed to a target.

The weighted flag includes: (i) a head portion having a pouch containing a weighted, granular material, with the head portion having a front end and a back end; and (ii) a tail portion attached to and extending from the back end of the head portion, where the tail portion includes a substantially cone-shaped pocket having a tapered tip end and an opposing flared end, with the tapered tip end being attached to the back end of the head portion. In one embodiment, the weighted flag of the present invention further includes a securing component for preventing or inhibiting the weighted, granular material contained in the head portion from migrating into the tapered tip of the tail portion. In another embodiment, the weighted flag further includes a neckband for covering a region where the head portion and tail portion attach to one another.

In another aspect, the present invention provides a method of making a weighted flag for use as an aerodynamic projectile directed to a target. This method involves the steps of: (i) providing a first piece of material having a pattern effective to form a head portion having a pouch when filled with a weighted, granular material; (ii) providing a second piece of material having a pattern effective to form a tail portion having a substantially cone-shaped pocket having a tapered tip end and an opposing flared end when said tapered tip end is attached to the back end of the head portion; (iii) attaching the tapered tip end of the tail portion to the back end of the head portion to yield a pocket-like structure; (iv) filling the head portion with a weighted, granular material to form the pouch containing the weighted, granular material, thereby yielding a weighted flag having a head portion and a tail portion. In one embodiment, the method further comprises installing a securing component at or near a location where the head portion attaches to the tail portion, where the securing component is installed in a manner effective for preventing or inhibiting the weighted, granular material contained in the head portion from migrating into the tapered tip of the tail portion. In another embodiment, the method further comprises positioning a neckband over a region where the head portion and tail portion attach to one another, where the neckband is positioned in a manner effective to produce a substantially tubular support between the head portion and the tail portion.

In another aspect, the present invention provides an apparatus for receiving and storing a tossable object. As used herein, this apparatus is also referred to as the "target apparatus." The apparatus includes: (i) a chamber having a rigid or semi-rigid sidewall component forming a hollow core and having at least one opening for receiving a tossable object therethrough, with the chamber having a top end and a bottom end; (ii) a base portion disposed below the bottom end of the chamber for the purpose of maintaining the chamber in a substantially upright orientation, with the base portion being configured to house a weighted material for stabilizing the apparatus; and (iii) a shell component fitted around the chamber and the base portion in a manner that keeps the chamber on top of the base portion, with the shell component having at least one opening that corresponds with the at least one opening of the chamber. In one embodiment, the apparatus further includes a sleeve fitted around at least a portion of the shell component, where the sleeve either includes or does not include at least one opening that corresponds with the at least one opening of the shell component, the sleeve having a decorative placement thereon or effective to receive a decorative placement thereon.

In a further aspect, the present invention provides a method of making an apparatus for receiving and storing a tossable object. This method involves the steps of: (i) providing a chamber having a rigid or semi-rigid sidewall component forming a hollow core and having at least one opening for receiving a tossable object therethrough, with the chamber having a top end and a bottom end; (ii) providing a base portion to be disposed below the bottom end of the chamber for the purpose of maintaining the chamber in a substantially upright orientation, with the base portion being configured to house a weighted material for stabilizing the apparatus; and (iii) fitting a shell component around the chamber and the base portion in a manner that keeps the chamber on top of the base portion, with the shell component having at least one opening that corresponds with the at least one opening of the chamber.

In another aspect, the present invention provides a toss game set comprising: (i) at least one weighted flag according to the present invention; and (ii) at least one target at which the at least one weighted flag is to be tossed as an object for playing the corresponding toss game, the at least one target comprising an apparatus for receiving and storing a tossable object according to the present invention.

In yet another aspect, the present invention provides a method of play for a weighted flag toss game. This method involves the steps of: (i) providing to at least one player a weighted flag and at least one target for the weighted flag; (ii) tossing of the weighted flag by the at least one player at the target for the purpose executing a scoring action, where the value of the scoring action is based on proximity of the tossed weighted flag, after coming to a resting state, in relation to the target or in relation to a designated area in, on, or nearby the target; and (iii) determining a total value of scoring actions for the at least one player, where the total value of scoring actions is calculated by adding the value of cumulative scoring actions for the at least one player.

The present invention provides a number of improvements over the various toss games currently available for recreational use. For example, the weighted flags of the present invention provide toss game pieces that have a unique and predictable flight dynamic (e.g., trajectory) and that can resemble football referee penalty flags or coaches challenge flags (e.g., in professional football instant replay challenges). In addition, the target apparatuses of the present invention can be designed to resemble football end zone pylons. Thus, the weighted flags and target apparatuses can be combined into a toss game set that is thematically linked to the popular sport of football. Other games do not have the form factor/design to serve as a fan memorabilia item that is ready for display (e.g., in the household on the mantle, in the office as a doorstop, in the game room on a shelf, etc.) when the game is not being used for play. The present invention improves on toss games currently on the market by being portable, packing small and light, by utilizing referee-styled weighted flags as dynamic, accurate tossable objects, and by using target apparatuses that can resemble football end zone pylons that are sturdy, stand anywhere, and ultra-visible targets. The present invention also provides game pieces that will not damage a playing surface and that will not be damaged by a playing surface. Therefore, the weighted flags and target apparatuses can be used for game play on any surface, indoors or outdoors, whether it be on carpet, hardwood floors, linoleum, tiled floors, grass, dirt, sand (e.g., at the beach), snow, pavement, asphalt (e.g., during tailgating at a game), etc. Additionally, the present invention serves as a fan memorabilia item that is intended to be displayed when it is not being played (during storage periods).

These and other objects, features, and advantages of this invention will become apparent from the following detailed description of the various aspects of the invention taken in conjunction with the accompanying drawings.

BRIEF DESCRIPTION OF THE DRAWINGS

For the purpose of illustrating aspects of the present invention, there are depicted in the drawings certain embodiments of the invention. However, the invention is not limited to the precise arrangements and instrumentalities of the embodiments depicted in the drawings. Further, if provided, like reference numerals contained in the drawings are meant to identify similar or identical elements.

FIG. 7A is a view of the target apparatus and its individual component parts—i.e., the chamber, the base portion, and the shell component—prior to final assembly. FIG. 7B shows the target apparatus in game play mode, i.e., with the openings accessible to tossable objects (e.g., a weighted flag). The target apparatus shown in these figures is an embodiment having two openings in the chamber and the shell component for receiving a tossable object (e.g., a weighted flag). The openings are on the top of the chamber and on the front side wall of the chamber of the target apparatus, as well as in the corresponding top and side of the shell component of the target apparatus.

DETAILED DESCRIPTION OF THE INVENTION

Figure 1A:
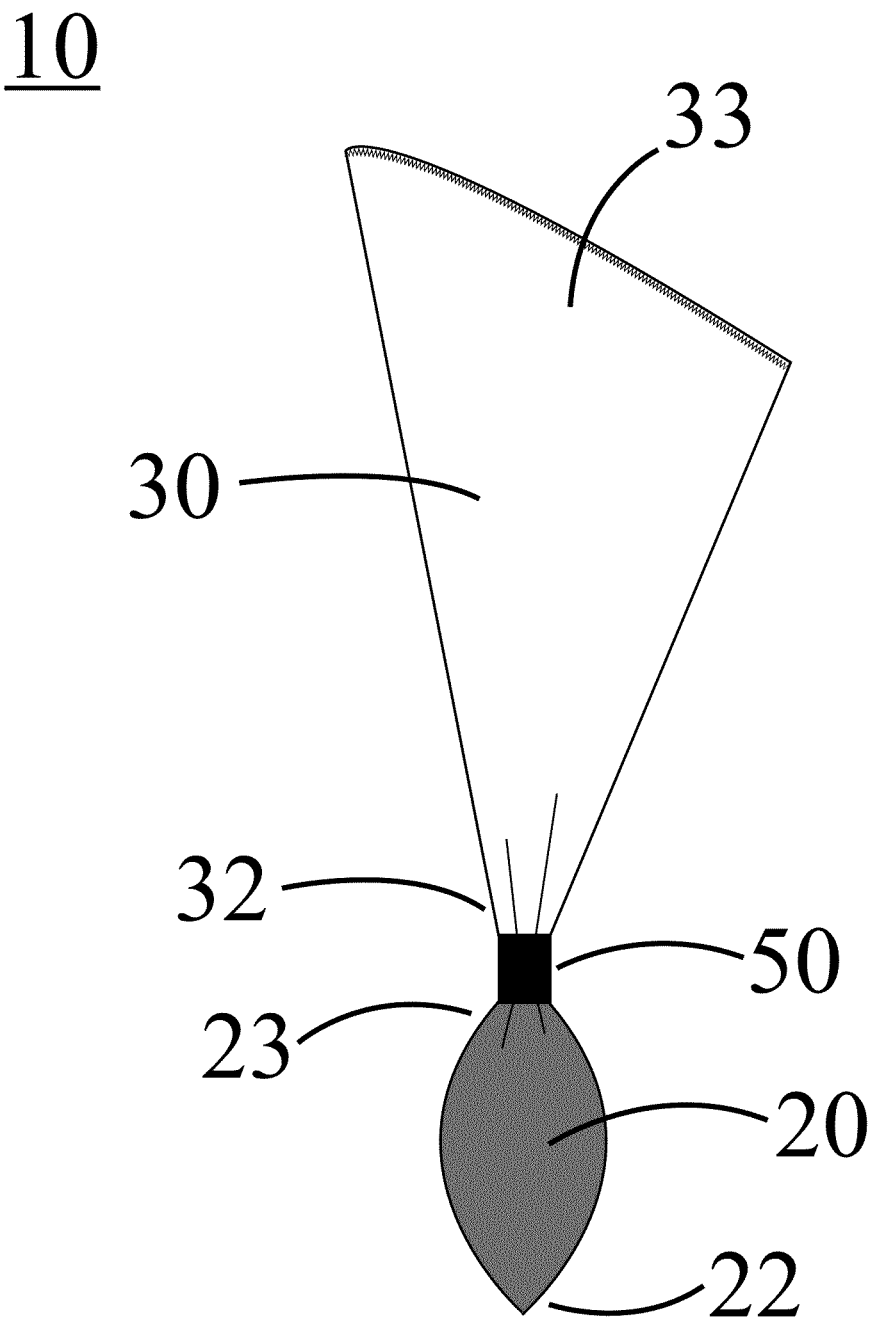
FIGS. 1A-1B are illustrations of embodiments of the weighted flag of the present invention.

The present invention relates to a weighted flag and a target apparatus for use in a toss game. The present invention also relates to a toss game set and associated methods of making and using the toss game set and its associated weighted flag and target apparatus.

In one aspect, the present invention provides a weighted flag for use as an aerodynamic projectile directed to a target. The weighted flag includes: (i) a head portion having a pouch containing a weighted, granular material, with the head portion having a front end and a back end; and (ii) a tail portion attached to and extending from the back end of the head portion, where the tail portion includes a substantially cone-shaped pocket having a tapered tip end and an opposing flared end, with the tapered tip end being attached to the back end of the head portion.

When filled with a weighted, granular material, the head portion of the weighted flag can have a variety of forms, including, without limitation, the following: a prolate spheroid, a sphere, a spheroid, an ovoid, a cone, a pyramid, three-dimensional triangle, a cube, and the like.

In one embodiment, the head portion and the tail portion are made from different materials. In another embodiment, the head portion and the tail portion are made from the same or similar materials.

The head portion can be made of any material suitable for forming a pouch that is effective to maintain the weighted, granular material therein. In various embodiments, the head portion of the weighted flag can be made of a material effective to be used on a variety of surfaces or under a variety of environmental conditions (e.g., sun, rain, hail, snow, sleet, wind, etc.). For example, the weighted flag can be made so that it can be used as an aerodynamic projectile on surfaces such as grass, snow, dirt, sand, asphalt, granite, carpet, linoleum, wood, rubber, porcelain, stone, gravel, rocks, ceramic, and the like. In one embodiment, the head portion is made from a material that is durable, abrasion-resistant, and/or weather-resistant. Therefore, in various embodiments, the head portion is made of a material effective to prevent or slow the head portion from degrading when used on an abrasive surface such as asphalt or in inclement weather such as snow and sleet. Suitable materials for use in making the head portion can include, without limitation, the following materials: microfiber, nylon, polyester, olefin, cotton, hemp, leather, suede, synthetic leather, synthetic suede, rubber, rubber-coated fabrics, vinyl-coated fabrics, ripstop fabrics, ballistic fabrics, fiberglass fabrics, lyocell, denim, and the like.

The tail portion of the weighted flag of the present invention can be made from any material suitable for enabling the tail portion to function as a trailing tail of the head portion of the weighted flag when the weighted flag is tossed into the air. Therefore, in one embodiment, the tail portion is made from any material that is lightweight, tear-resistant, and/or weather resistant. Suitable examples of materials that can be used for the tail portion of the weighted flag include, without limitation, the following: lightweight ripstop fabric, nylon, polyester, microfiber, cotton, linen, hemp, bamboo, taffeta, silk, synthetic silk, rayon, spandex, lyocell, olefin, and the like.

As provided herein, the tail portion of the weighted flag is a substantially cone-shaped pocket having a tapered tip end and an opposing flared end. The flared end corresponds to the opening end of the pocket, while the tapered tip, which is attached to the head portion, corresponds to the bottom, closed end of the pocket. While the flared end of the tail portion is generally provided in an opened configuration, in certain embodiments, the flared end of the tail portion can instead be sealed, partially sealed, or sealable.

The term "sealed" as used herein to describe the flared end refers to a substantially permanent sealing of the flared end (e.g., a sewn or glued seal designed to maintain the flared end in a closed configuration).

The term "sealable" as used herein to describe the flared end refers to a configuration that allows for the repeatable closing and opening of the flared end (e.g., by operation of a zipper, snaps, buttons, VELCRO® attachments, or ZIPLOC® style zipper to open and close the flared end).

In certain embodiments that have a tail portion with a sealable flared end, the internal pocket region of the tail portion can be used as a storage pocket. For example, in these embodiments, the tail portion can be used to store or house an inflated balloon, where the balloon can be filled with air, carbon dioxide, oxygen, or helium. In a particular embodiment whereby the balloon is filled with helium, the amount of helium can be adjusted so that the weighted, granular material contained in the head portion is still sufficient so that the weighted flag drops to the ground when tossed in the air. In such an embodiment, the helium can also be of sufficient amount in order to cause the tail portion of the weighted flag to remain off of the ground while at least a part (e.g., the tip or side) of the head portion remains in contact with the ground while in a rested state. Such a configuration can be used, for example, for more precise measurements of the head portion in relation to the desired target when used in a toss game, as well as for enabling a further skill component for a player of a toss game using the weighted flag. This configuration can also serve to enhance the hit-and-stick functionality of the weighted flag in a toss game competition, particularly where the scoring is associated with where the head portion of the weighted flag lands in relation to the desired target.

The weighted, granular material contained in the head portion of the weighted flag can be of any suitable material that is able to fill the head portion in a manner sufficient to cause the head portion to form into the desired three-dimensional shape (e.g., sphere, prolate spheroid, cube, cone, etc.). Suitable materials for use as the weighted, granular material contained in the head portion of the weighted flag can include, without limitation, sand, dirt, plastic pellets, metallic pellets, rubber pellets, seeds, beans, grains, kernels, hulls, pebbles, beads, and the like, as well as various mixtures of these materials.

In one embodiment, the weighted flag of the present invention further includes a securing component for preventing or inhibiting the weighted, granular material contained in the head portion from migrating into the tapered tip of the tail portion. The securing component can be any device that is able to sufficiently partition the head portion from the tail portion in manner sufficient to prevent or inhibit migration of the weighted, granular material from the head portion to the tail portion. Examples of suitable securing components can include, without limitation, a zip tie, tape, elastic bands, binders, string, clasps, ferrules, crimps, clamps, snaps, stitches, straps, hook and loop fasteners, zippers, and the like.

In another embodiment, the weighted flag further includes a neckband for covering a region where the head portion and tail portion attach to one another (referred to herein as the "head portion-tail portion intersection"). Further, the neckband can be positioned so that it covers the securing component, particularly if the securing component is placed around the external region where the head portion and tail portion attach to one another. In addition, the neckband can be designed to function as a stabilizer for the head portion-tail portion intersection, which can be effective to make for a more linear flight trajectory of the weighted flag. The neckband can be made of any suitable material effective to fit around the aforementioned head portion-tail portion intersection and the securing component. Suitable examples of neckband materials include, without limitation, elastic bands, VELCRO® bands, crimps (e.g., metallic crimps), ferrules (e.g., metallic ferrules), string (e.g., tied in a whipping knot), tape, and the like.

The weighted flag is effective for use in a toss game where the objective is to toss the weighted flag at a target so that it lands on, in, or the closest to the target. For example, as provided herein, the weighted flag is designed to hit-and-stick its landing. Further, the weighted flag is designed as an accurate, tossable object that can cut through wind and have a minimal hop upon landing. Therefore, due to the repeatable flight trajectory, one attribute is that the weighted flag can be used in a game of skill as opposed to a game of chance.

In another aspect, the present invention provides a method of making a weighted flag for use as an aerodynamic projectile directed to a target. This method involves the steps of: (i) providing a first piece of material having a pattern effective to form a head portion having a pouch when filled with a weighted, granular material; (ii) providing a second piece of material having a pattern effective to form a tail portion having a substantially cone-shaped pocket having a tapered tip end and an opposing flared end when said tapered tip end is attached to the back end of the head portion; (iii) attaching the tapered tip end of the tail portion to the back end of the head portion to yield a pocket-like structure; (iv) filling the head portion with a weighted, granular material to form the pouch containing the weighted, granular material, thereby yielding a weighted flag having a head portion and a tail portion.

In one embodiment, the method further comprises installing a securing component at or near a location where the head portion attaches to the tail portion, where the securing component is installed in a manner effective for preventing or inhibiting the weighted, granular material contained in the head portion from migrating into the tapered tip of the tail portion.

In another embodiment, the method further comprises positioning a neckband over a region where the head portion and tail portion attach to one another, where the neckband is positioned in a manner effective to produce a substantially tubular support between the head portion and the tail portion.

The present invention provides various alternative embodiments of the weighted flag of the present invention. For example, in one embodiment, the weighted flag can be configured so that there is no granular material contained in the head portion. One way to make this embodiment is to push the tail portion fabric through a hole in a rubber piece/ball, and then tie a knot so that the ball is secured onto the tail. This embodiment can also be made by riveting the flag tail to the rubber piece/ball.

Figure 1B:
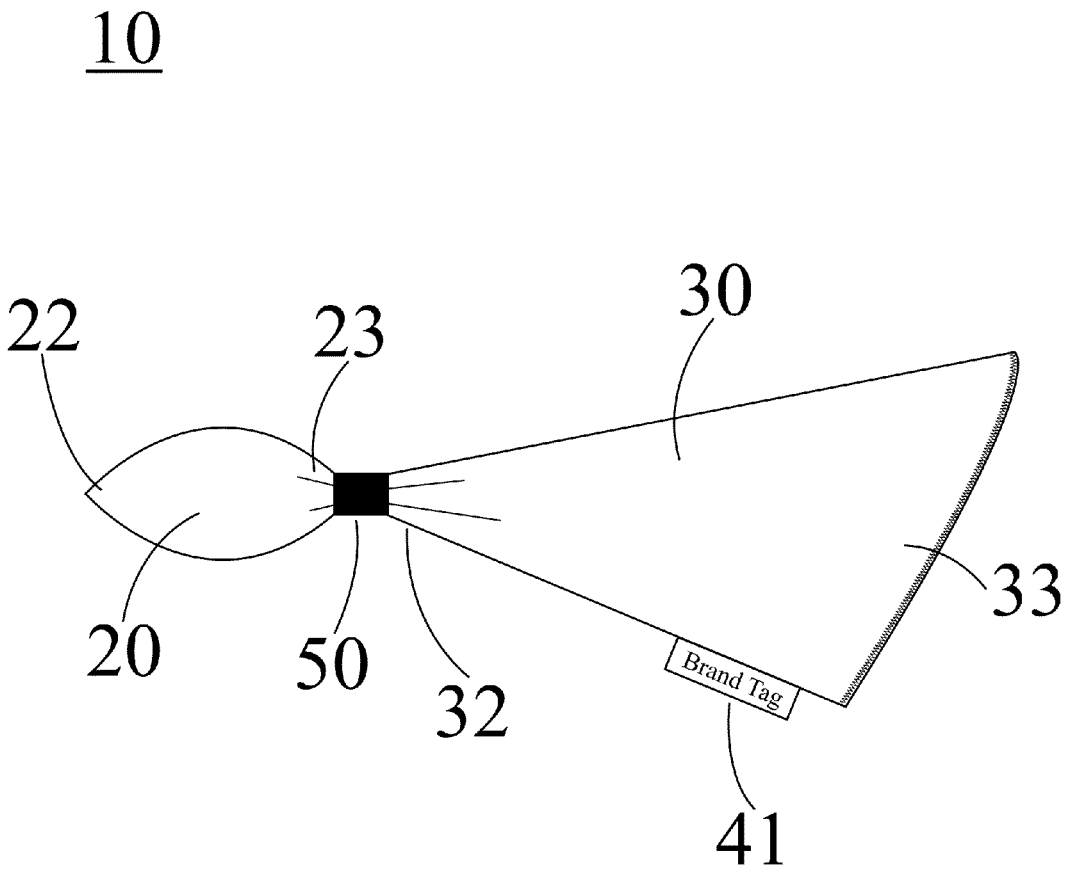

FIGS. 1A-1B show various embodiments of a weighted flag of the present invention. As shown in FIGS. 1A and 1B, weighted flag 10 includes head portion 20, tail portion 30, and neckband 50. FIG. 1A illustrates head portion 20 and tail portion 30 having a different color, while FIG. 1B illustrates head portion 20 and tail portion 30 having the same color. However, as disclosed herein, the materials used for head portion 20 and tail portion 30 can be the same or different materials. Therefore, FIGS. 1A and 1B are meant to illustrate both of these configurations, even if the colors are the same or different. Head portion 20 has front end 22 and back end 23. Head portion 20 forms a pouch containing a weighted, granular material (not shown). In the embodiment shown in FIGS. 1A and 1B, head portion 20 is in the form of a prolate spheroid. Tail portion 30 is attached to and extends from back end 23 of head portion 20. Tail portion 30 includes a substantially cone-shaped pocket having tapered tip end 32 and opposing flared end 33, with tapered tip end 32 being attached to back end 23 of head portion 20. In the embodiment shown in FIGS. 1A and 1B, tail portion 30 is in the form of a cone-shaped pocket similar to a waffle-style ice cream cone, where the open end of the cone has a graduated angle. Neckband 50 is shown covering the region where head portion 20 and tail portion 30 attach to one another. Neckband 50 also covers the securing component (not shown) that is positioned at or near the region where head portion 20 and tail portion 30 attach to one another. The securing component is effective for preventing or inhibiting the weighted, granular material contained in head portion 20 from migrating into tail portion 30 through tapered tip end 32 of tail portion 30.

FIGS. 2A-2H show one embodiment of the steps of how to make a weighted flag of the present invention, as described below:

Step 1 (FIG. 2A): Cut first piece of material 24 having a pattern effective to form a head portion from a raw stock fabric and cut second piece of material 34 having a pattern effective to form a tail portion from a raw stock fabric. First piece of material 24 can be made out of a durable, abrasion-resistant fabric, while second piece of material 34 can be made out of a lightweight fabric.

Step 2 (FIG. 2B): Sew stitching 35 (e.g., a tight serge stitch) onto the outside edge of flared end 33 of tail portion 30.

Step 3 (FIG. 2C): Lay first piece of material 24 (head portion) right-side-down on top of second piece of material 34 (tail portion) that is right-side-up. Stitch first piece of material 24 (head portion) to second piece of material 34 (tail portion) using, for example, a ⅜th-inch seam allowance, thereby yielding combined material 36. As used in this step, the term "right side" refers to the side of the fabric that will ultimately face-out when the weighted flag is complete.

Step 4 (FIG. 2D): Unfold first piece of material 24 (head portion) from second piece of material 34 (tail portion) so that the right sides are facing up. This results in combined material 36 having mirror images that are separated by an imaginary middle line 39 that runs from head end 37 to tail end 38 of combined material 36.

Step 5 (FIG. 2E): Fold combined material 36 in half, with the right-side-in (inside-out). Optionally, pin brand tag 41 so that it is sandwiched between the two layers of tail portion 30, opposite the fold line, a ½-inch down from the outside edge of flared end 33 of tail portion 30. Sew the perimeter of combined material 36 as diagramed using, for example, a ⅜th-inch seam allowance. In one embodiment, this seam can be sewn with ultra-strong, abrasion-resistant thread. It can also be sewn with a twin needle/double needle to provide an extra stitch-line for reinforcement.

Step 6 (FIG. 2F): Turn combined material 36 right-side-out, to hide the stitching and complete the substantially cone-shaped pocket.

Step 7 (FIG. 2G): Fill head portion 20 with weighted, granular material 25 by pouring the weighted, granular material through flared end 33 of tail portion 30. In one embodiment, head portion 20 is filled with about 2½ ounces of loose fill sand (as the weighted, granular material).

Step 8 (FIG. 2H): Install securing component 40 (e.g., a zip-tie) to secure the weighted, granular material (e.g., sand) into head portion 20.

Step 9: Provide or make a neckband for covering the securing component. In one embodiment, the neckband is made by cutting a length of elastic strap fabric (e.g., 2 inches long and 1 inch wide). Fold the elastic strap fabric in half, right-side-in. Then sew the open end together with a ⅜th-inch seam allowance. Turn the elastic fabric right-side-out to hide the stitching and form the complete neckband, which is an elastic fabric tube in this embodiment.

Figure 2A:
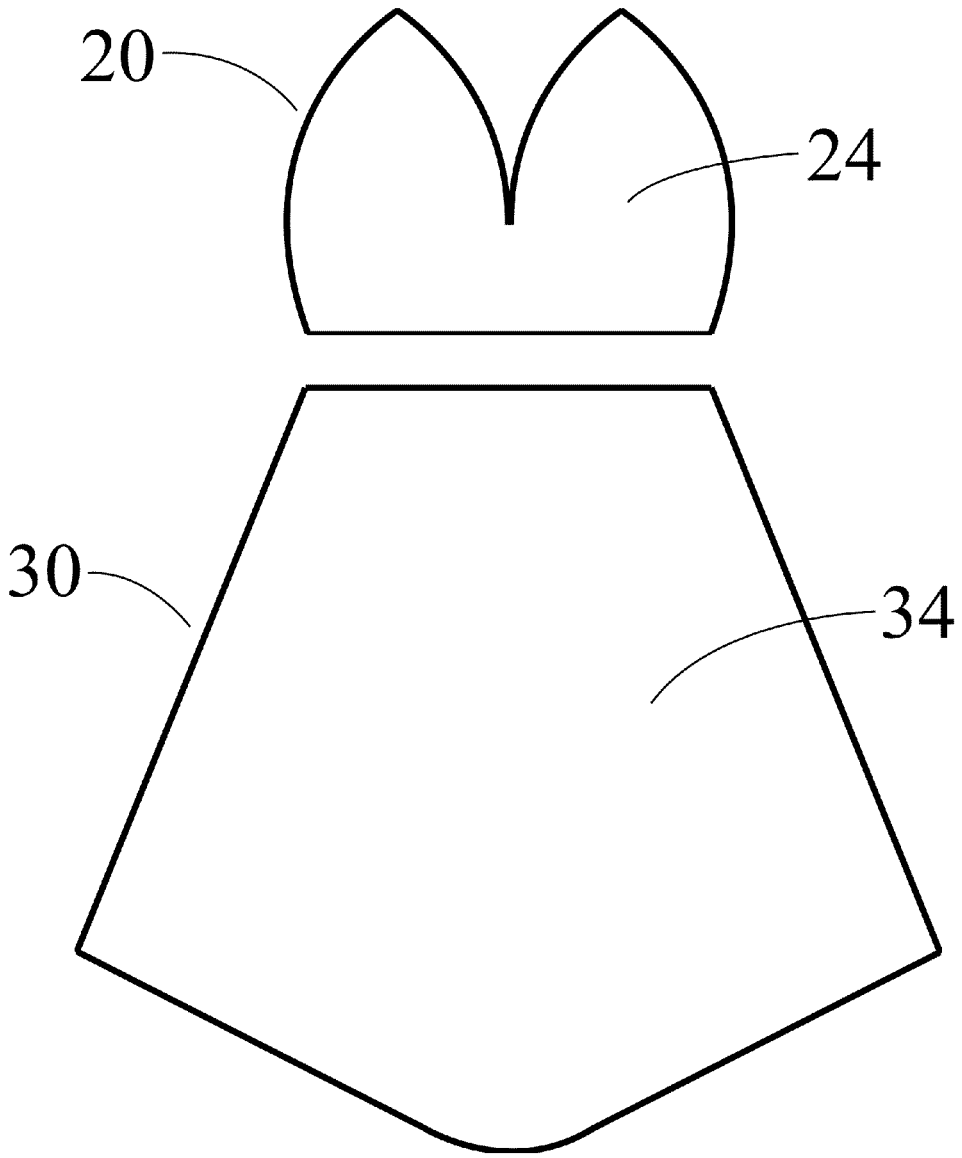
FIGS. 2A-2I are illustrations showing one embodiment of how to make a weighted flag of the present invention.
Figure 2B:
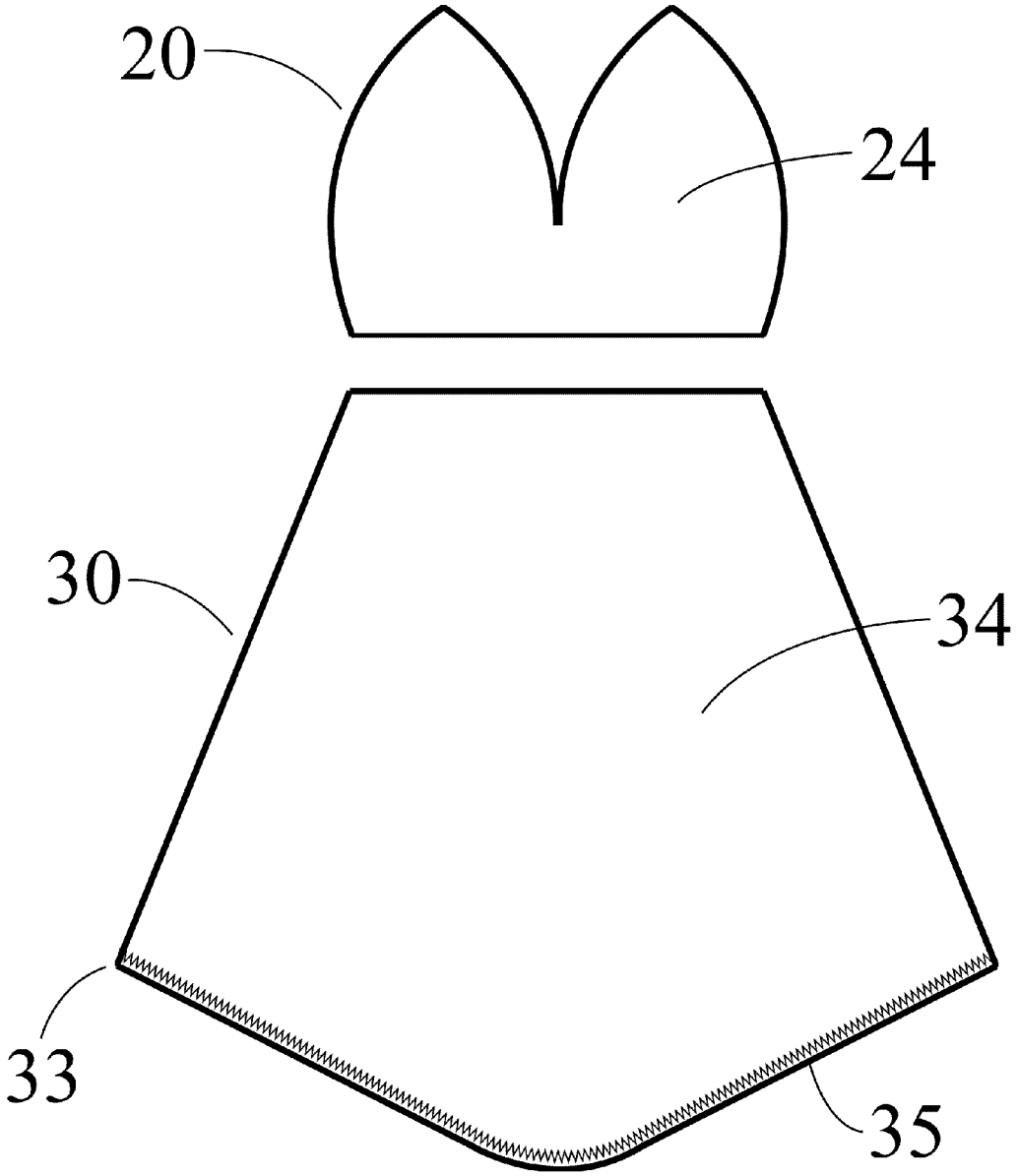
Figure 2C:
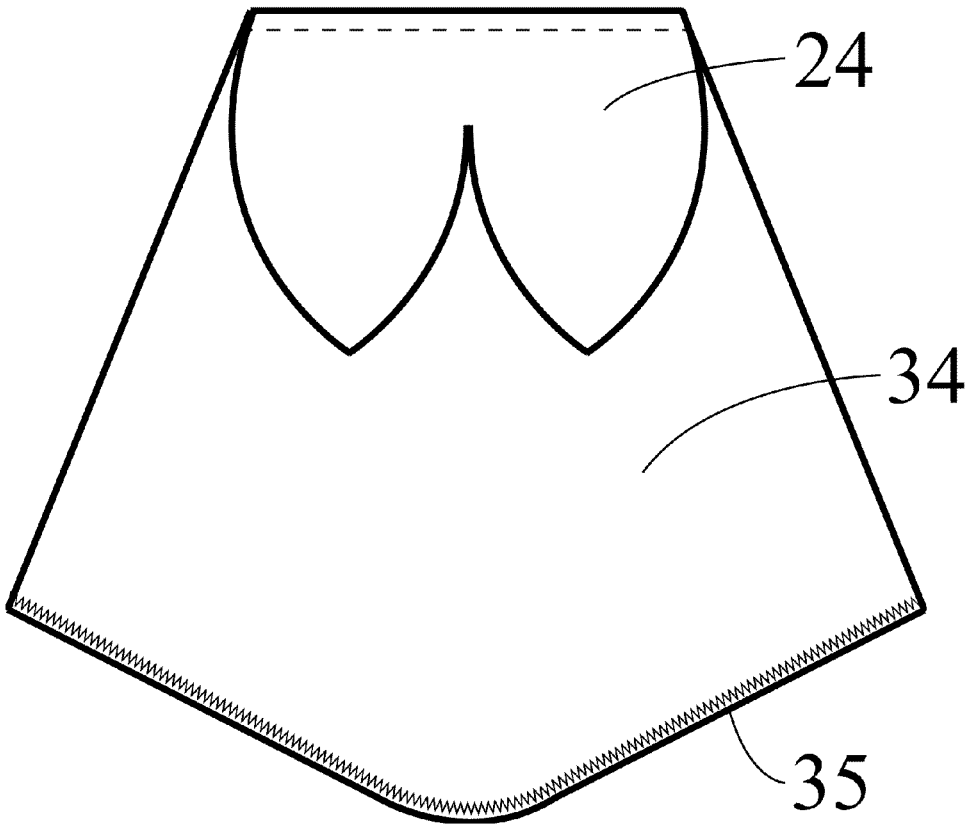
Figure 2D:
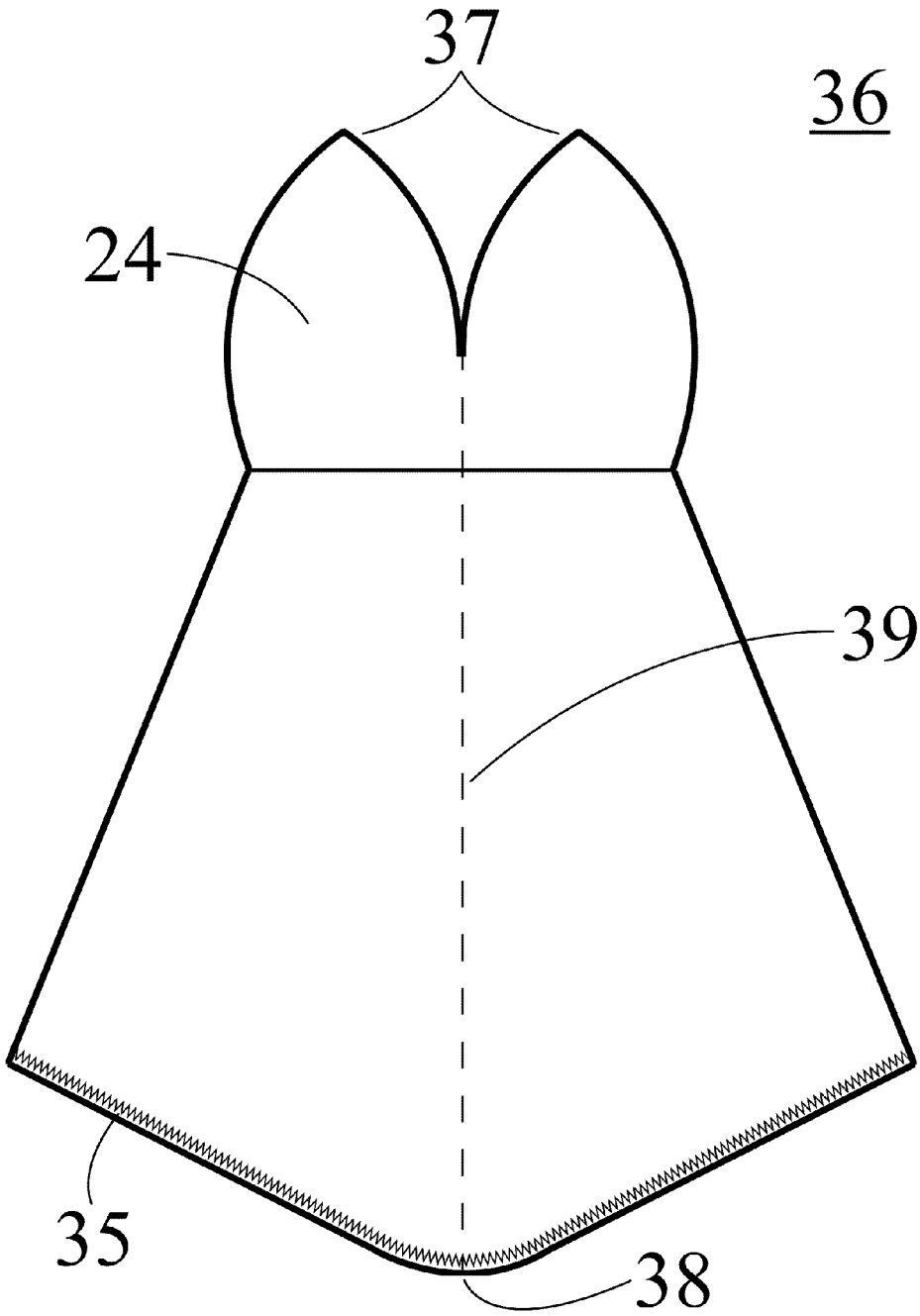
Figure 2E:
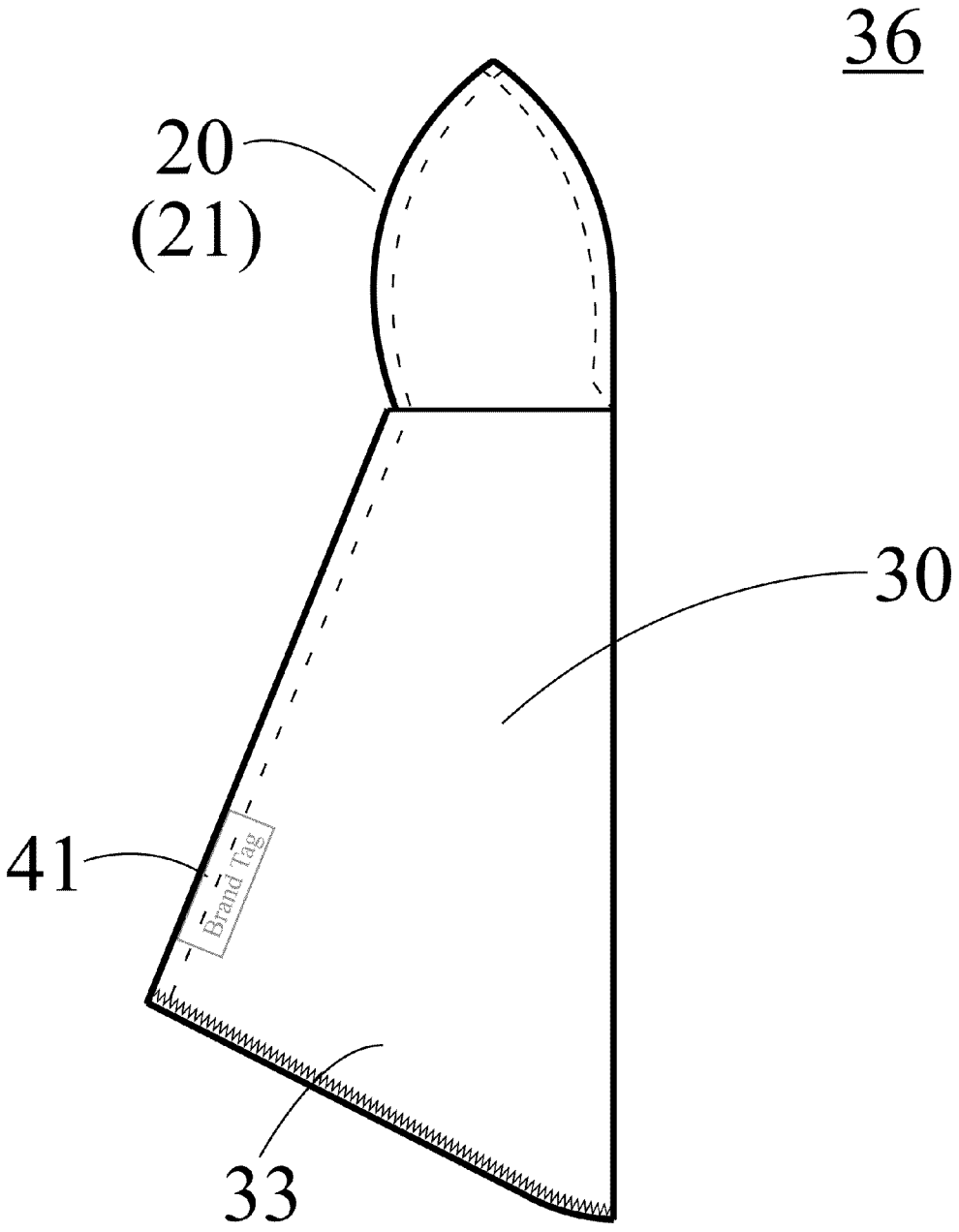
Figure 2F:
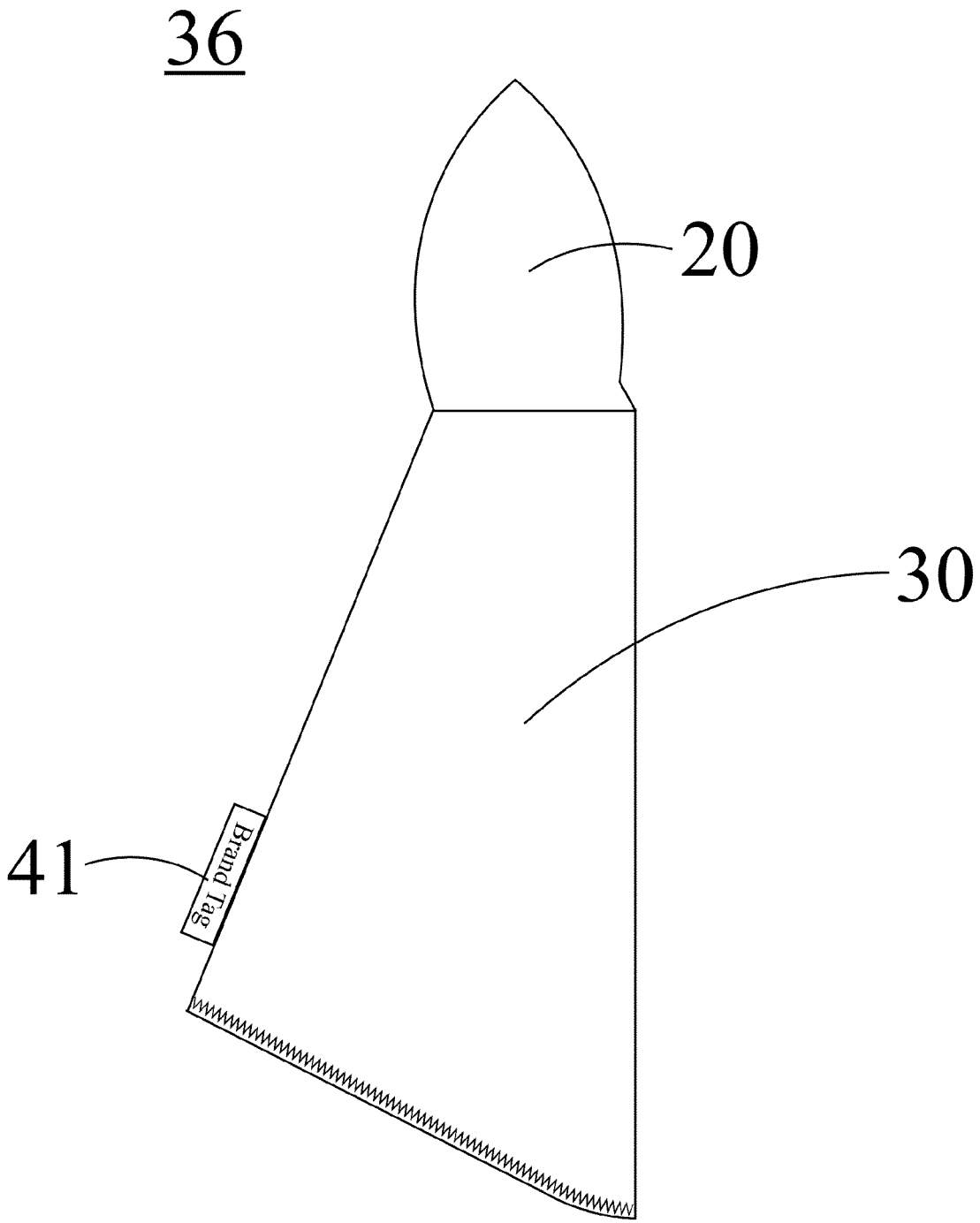
Figure 2G:
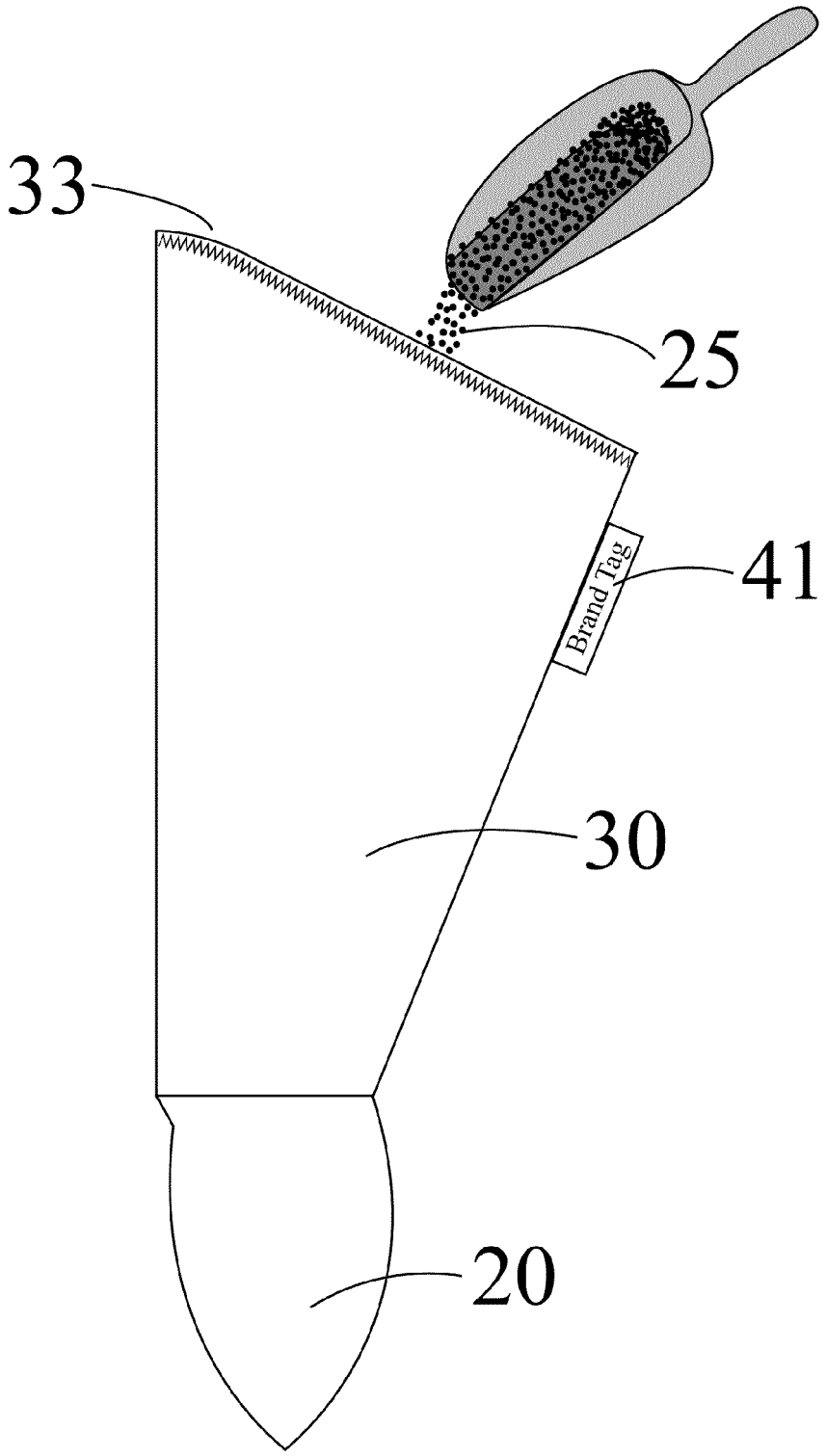
Figure 2H:
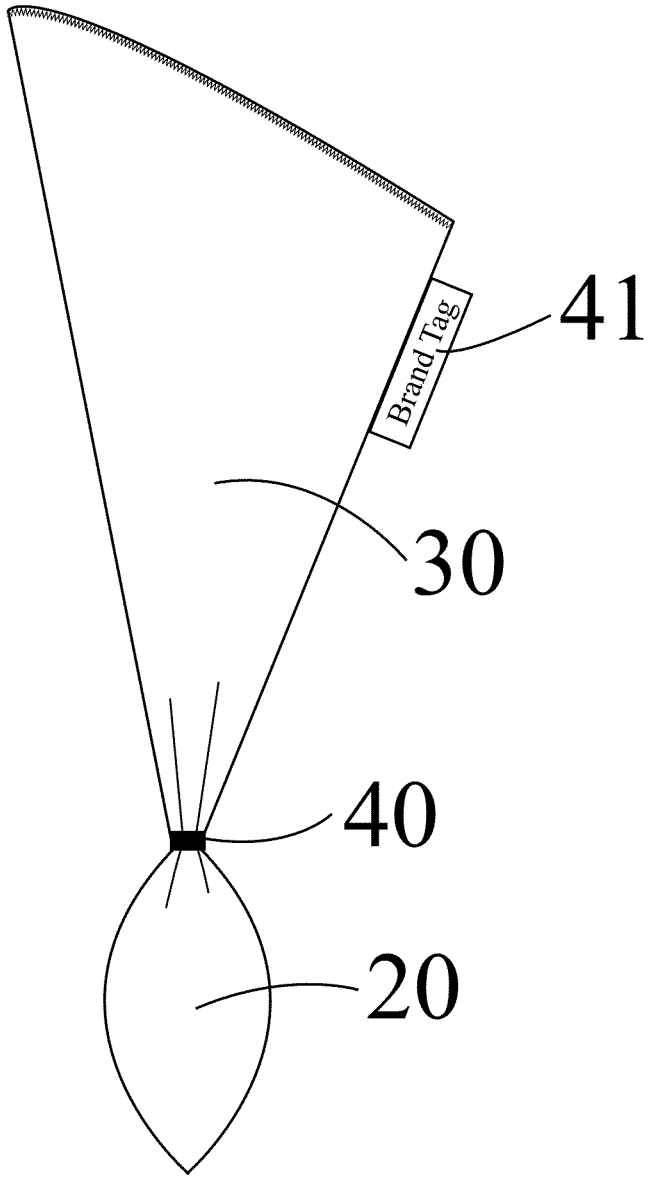
Figure 2I:
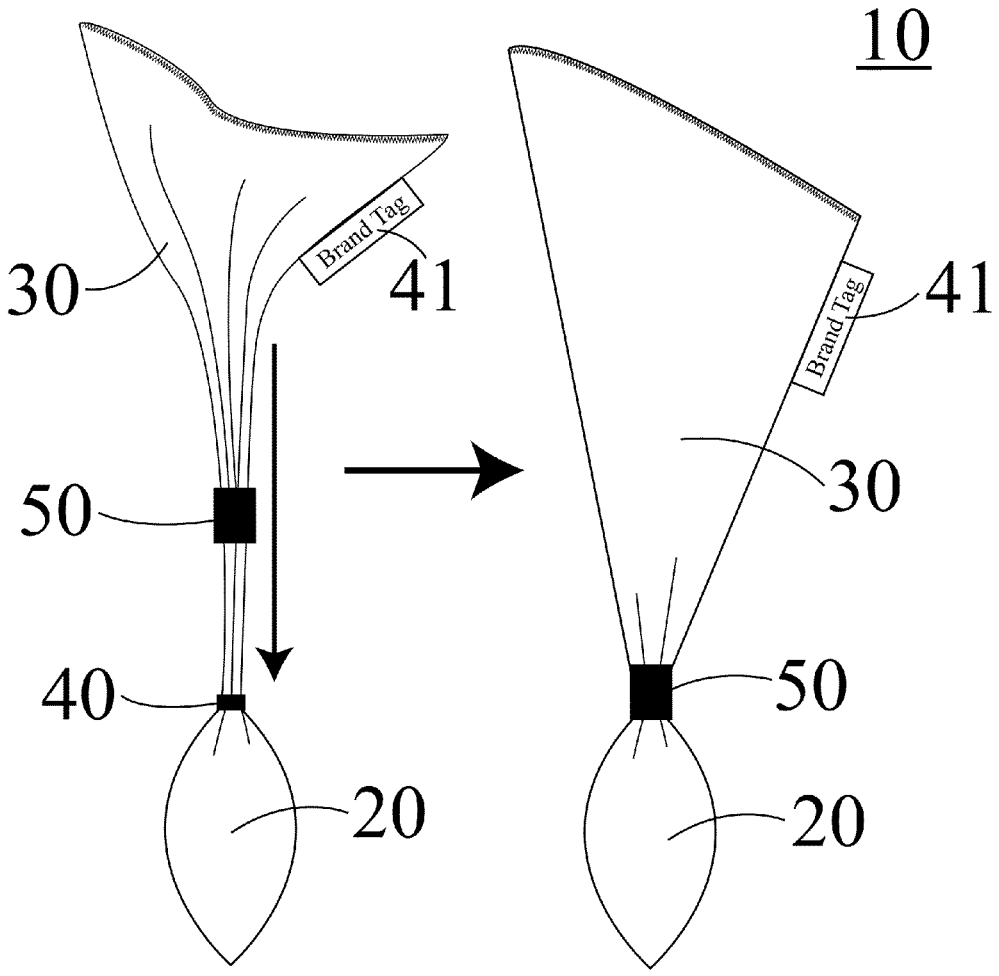

Step 10 (FIG. 2I): Slip neckband 50 over flag portion 30 and secure it (e.g., via elastic stretch) around securing component 40 (e.g., zip-tie). Weighted flag 10 is now complete and ready for use.

While the weighted flag of the present invention can be made according to the above-described method, the present invention is not limited to that particular method. As noted above and below, one non-limiting example of making a weighted flag of the present invention can be described as a two-panel flag (also referred to as the pocket pattern flag) methodology or configuration. Another non-limiting example of making a weighted flag of the present invention can be described as a four-panel flag methodology or configuration. These methods are further summarized or described below.

Two-Panel Flag:

An example of the steps for making a 2-panel flag are as follows: A fabric pattern for the Flag Tail is cut from a roll of raw stock fabric (e.g. ripstop nylon). A fabric pattern for the Durable Flag Head is cut from a roll of raw stock fabric (e.g. weather and abrasion-resistant fabric—such as synthetic suede or 1000 denier fabric). The Durable Flag Head is sewn onto the Flag Tail. The outer edge of the Flag Tail is hemmed or sewn with a serge stitch to prevent fraying. The fabric pattern is then folded in half and sewn together to form a complete pocket, or Flag Pocket. The Flag Pocket is then turned inside-out to hide its stitching. It is filled with a weighted material (e.g. sand) and then a cable tie (e.g. nylon or stainless steel) is zipped/clasped into place where the Durable Flag Head meets the Flag Tail. This cable tie secures the sand into the Flag Head and prevents it from leaking. A Flag Neck Band is made by taking a short length of elastic fabric, doubling it back upon itself and sewing it into a tube shape. This Flag Neck Band is stretched-out to slide over the Flag's Tail and then secured by its elastic contraction on top of the cable tie. This Flag Neck Band serves as an aesthetic cover above the cable tie and it also stabilizes the joint between the Flag Head and the Flag Tail to make for a more linear flying object. Once the Flag Neck Band is in place, the flag is complete.

Four-Panel Flag:

An example of the steps for making a 4-panel flag are as follows: The 4-Panel Flag is designed with a Flag Head that matches a football in shape (like the 2-panel flag), but additionally it matches a football in that it is constructed using 4-panels. A fabric pattern for the Flag Tail is cut from a roll of raw stock fabric (e.g. ripstop nylon). The outer edge of the Flag Tail is hemmed or sewn with a serge stitch to prevent fraying. The Flag Tail pattern is folded in half and sewn into a cone shape. The Flag Tail is then turned inside-out to hide its stitching. Fabric patterns for four separate Flag Panels are cut from a roll of raw stock fabric (e.g. weather and abrasion-resistant fabric—such as synthetic suede or 1000 denier fabric). The four Flag Panels are sewn together to form a football-shaped pouch, that has one end open. The football-shaped pouch is the Durable Flag Head. A funnel is used to pour a weighted material (e.g. sand) into the Durable Flag Head. The tip of the cone-shaped Flag Tail is attached to the Durable Flag Head as it is sewn shut with a seam. The 4-Panel Flag is now complete.

In another aspect, the present invention provides an apparatus for receiving and storing a tossable object. The apparatus includes: (i) a chamber having a rigid or semi-rigid sidewall component forming a hollow core and having at least one opening for receiving a tossable object therethrough, with the chamber having a top end and a bottom end; (ii) a base portion disposed below the bottom end of the chamber for the purpose of maintaining the chamber in a substantially upright orientation, with the base portion being configured to house a weighted material for stabilizing the apparatus; and (iii) a shell component fitted around the chamber and the base portion in a manner that keeps the chamber on top of the base portion, with the shell component having at least one opening that corresponds with the at least one opening of the chamber.

The chamber of the apparatus of the present invention can be of any cross-sectional shape. Examples of suitable cross-sectional shapes of the chamber can include, without limitation, a square, a rectangle, a triangle, a circle, an oval, a star, and the like. Without meaning to be limited to the aforementioned cross-sectional shapes, the chamber can have any cross-sectional shape that can form an opening into which a weighted flag of the present invention can fit.

In one embodiment, the chamber has a cross-sectional shape and dimensions that are maintained or substantially maintained from the top end to the bottom end of the chamber. In another embodiment, the chamber can be designed to create a slight angle on the chamber pieces so that one can nest chamber piece inside of another during shipment/storage. In a particular embodiment, the angle can be such that it is so slight that it would not be perceptible once the chamber is placed into the shell component (e.g., the complete apparatus will look as if it is a uniform shape from top to bottom).

In another embodiment, the at least one opening for receiving a tossable object therethrough is positioned at the top end of the rigid or semi-rigid chamber or on the rigid or semi-rigid sidewall component of the chamber. In other embodiments, the chamber can have multiple openings for receiving the tossable object, with the multiple openings being positioned on the top end and at least at one side of the sidewall component of the chamber, or being positioned on more than one side of the sidewall component but not on the top end of the chamber.

The chamber (e.g., the sidewall component, the bottom end, and the top end) of the apparatus can be made of any rigid or semi-rigid material that can maintain a shape. Examples of suitable rigid or semi-rigid materials for use for the chamber can include, without limitation, plastic (e.g., polyvinyl chloride (PVC)), rubber, metal, cardboard, wood, foam, inflatable fabric, and the like.

The base portion of the target apparatus of the present invention can have a cross-sectional shape that is the same or different from the cross-sectional shape of the chamber. Further, the base portion of the target apparatus can be configured to house a weighted material that is effective to provide sufficient weight to stabilize the apparatus in a substantially upright orientation when positioned substantially perpendicular to a horizontal surface. Suitable weighted materials for use as or in the base portion can include, without limitation, sand, dirt, pebbles, beads, plastic, rubber, metal, water, concrete, seeds, beans, grains, kernels, hulls, and the like, as well as mixtures thereof.

The shell component of the target apparatus of the present invention can be made from a formable material. Suitable formable materials for use in making the shell component can include, without limitation, vinyl-coated fabrics (e.g., vinyl-coated nylon), vinyl, microfiber, nylon, polyester, olefin, cotton, hemp, leather, suede, synthetic leather, synthetic suede, rubber, rubber-coated fabrics, ripstop fabrics, ballistic fabrics, fiberglass fabrics, lyocell, denim, plastic, wood, metal, and the like. Many of the formable materials are suitable for forming the shell component via sewing techniques. With respect to rubber, plastic, wood, and metal shell components, other suitable methods known in the art to shape these materials would be employed to make the shell component. For example, a plastic shell component could be made by thermoforming, vacuum-forming, blow molding, injection molding, rotational molding, extrusion, etc. Further, a plastic shell component would be more of a rigid box design, as opposed to a fabric design according to other embodiments.

In one embodiment, the shell component can include a resealable flap covering the at least one opening of the chamber. In a particular embodiment, the shell component includes an attachment component for holding the resealable flap away from the at least one opening of the chamber and from the corresponding at least one opening of the shell component. The attachment component can be any mechanism that functions to keep the resealable flap from covering the at least one opening of the chamber and the corresponding at least one opening of the shell component. Suitable examples of such an attachment component can include, without limitation, snaps, buttons, VELCRO® attachments, magnets, reusable tape, latches, hooks, and the like.

In one embodiment, the apparatus further includes a sleeve fitted around at least a portion of the shell component, where the sleeve either includes or does not include at least one opening that corresponds with the at least one opening of the shell component, the sleeve having a decorative placement thereon or effective to receive a decorative placement thereon. The sleeve can be designed to slip over the shell component and then secured at a desired position around the shell component. Various embodiments of the sleeve can be either permanently or removeably affixed around the shell component. Any mechanism effective to affix the sleeve to the shell component can be used. Suitable examples of such mechanism can include, without limitation, elastic, VELCRO® attachments, snaps, laces, zippers, buttons, reusable tape, latches, hooks, and the like.

In various embodiments, the target apparatus of the present invention can be configured to resemble various objects known and readily recognizable to the public at large or to a particular group of people (e.g., players and spectators of well known sports). For example, in a particular embodiment, the target apparatus can be configured to resemble a football pylon (e.g., a football end zone pylon) in form, dimension, color, and/or texture. With regard to the football end zone pylon configuration, the target apparatus of the present invention can be configured to have the dimensions of a regulation football end zone pylon used in football games regulated under the National Football League (NFL) or the National Collegiate Athletic Association (NCAA), as well as under recreational, youth, and school (e.g., junior high and high school) football leagues. For example, similar to an NFL end zone pylon, the target apparatus can be configured to be 18 inches in height and have the cross-sectional shape and dimensions of a 4-inch by 4-inch square.

In a further aspect, the present invention provides a method of making an apparatus for receiving and storing a tossable object. This method involves the steps of: (i) providing a chamber having a rigid or semi-rigid sidewall component forming a hollow core and having at least one opening for receiving a tossable object therethrough, with the chamber having a top end and a bottom end; (ii) providing a base portion to be disposed below the bottom end of the chamber for the purpose of maintaining the chamber in a substantially upright orientation, with the base portion being configured to house a weighted material for stabilizing the apparatus; and (iii) fitting a shell component around the chamber and the base portion in a manner that keeps the chamber on top of the base portion, with the shell component having at least one opening that corresponds with the at least one opening of the chamber.

The present invention provides various alternative embodiments of the target apparatus of the present invention. For example, in one embodiment, the target apparatus is configured so that it secures to the ground through the use of a stake or stakes. Another embodiment of the target apparatus is one that is made of an inflatable air bladder (e.g., the target apparatus could be made out of raft-like material and inflated for use, then deflated for travel/storage). Another embodiment of the target apparatus is one configured so that the weighted material is added to the base portion by the user. For example, the base portion can be configured so that it can receive and house from the user a granular material such as sand from the beach or dirt in the backyard, where the user simply scoops the sand or dirt into the base portion. In another particular embodiment, the base portion can be configured so that it can receive a solid material, such as a weighted block, a beverage bottle (e.g., a plastic water bottle, a glass bottle), a beverage can (e.g., a soda can), or other canned good (e.g., soup can) as the weighted material. Further, the base portion can be configured so that it can receive and house any sort of liquid or liquid-like material as the weighted material. Another embodiment of the target apparatus is one that uses VELCRO® on the target apparatus and corresponding tossable object (e.g., flags, bean bags, balls, darts), so that scoring is based on where the tossable object sticks on the target apparatus versus what chamber slot it goes into. Another embodiment of the target apparatus can be one that is configured as a rigid box version.

Figure 3:
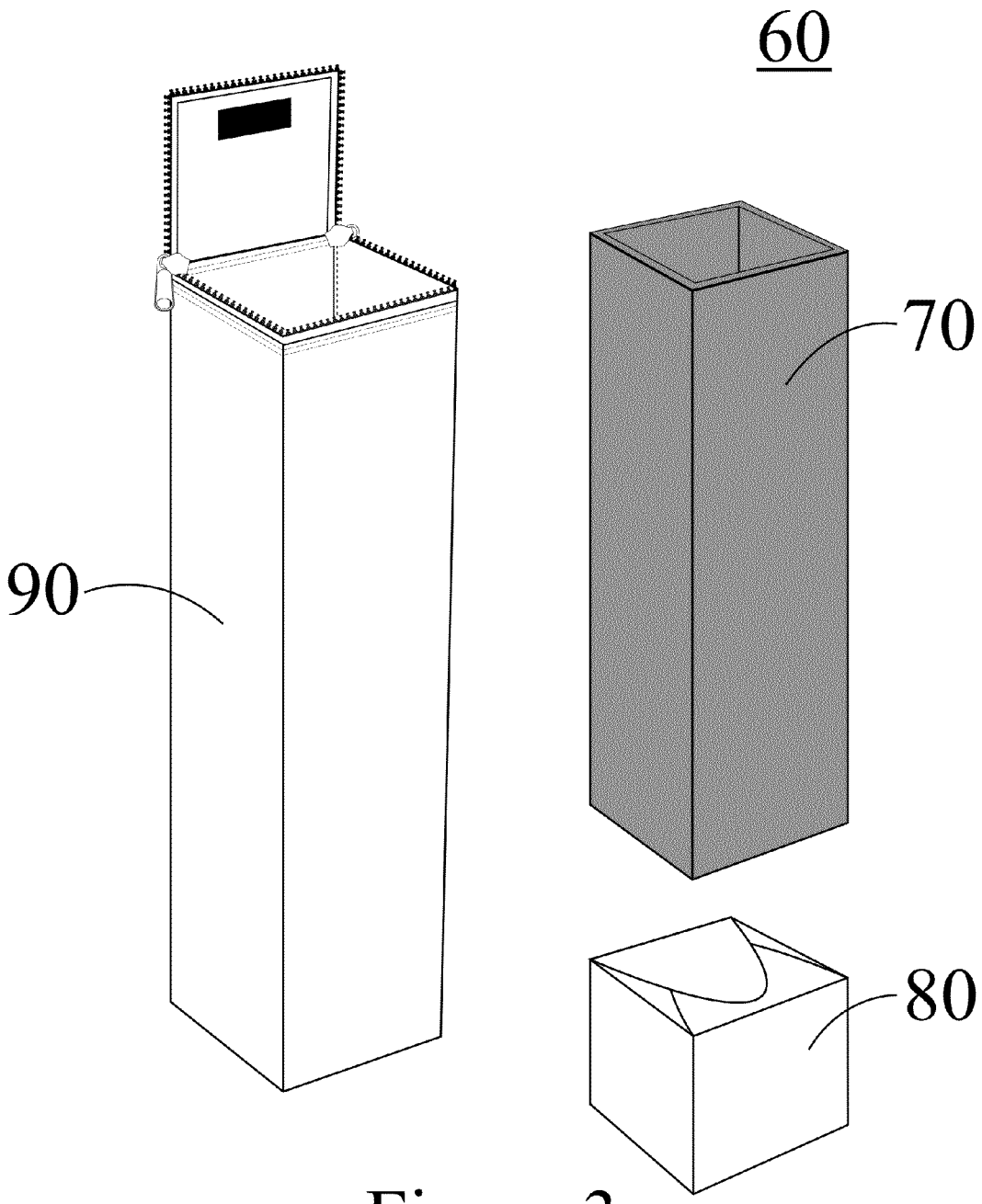
FIG. 3 is an illustration of one embodiment of a target apparatus of the present invention. The embodiment of the target apparatus is shown with its individual component parts—i.e., the chamber, the base portion, and the shell component—prior to final assembly.
Figure 4:
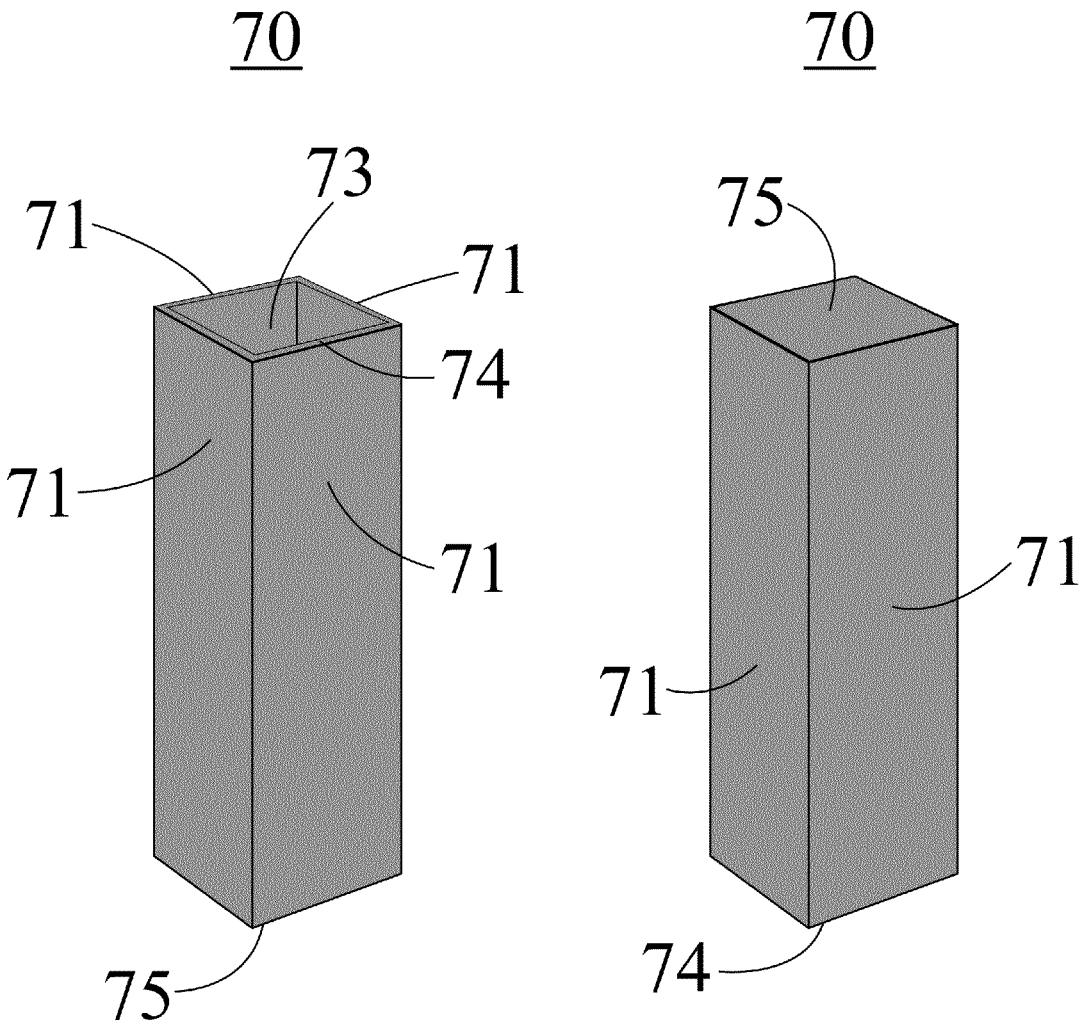
FIG. 4 are illustrations of one embodiment of a chamber of a target apparatus of the present invention. The chamber is shown in its upright (left side of figure) and upside down (right side of figure) positions.

FIGS. 3-8 show various embodiments of a target apparatus of the present invention and its component parts. As shown in FIG. 3, in one embodiment, target apparatus 60 for receiving and storing a tossable object includes chamber 70, base portion 80, and shell component 90. As shown in FIG. 4, chamber 70 has rigid or semi-rigid sidewall component 71 (shown in FIG. 4 with four sidewall components) forming a hollow core and having at least one opening 73 for receiving a tossable object therethrough, with chamber 70 having top end 74 and bottom end 75. As shown in FIGS. 3 and 4, base portion 80 is disposed below bottom end 75 of chamber 70 for the purpose of maintaining the chamber in a substantially upright orientation, with base portion 80 being configured to house a weighted material for stabilizing apparatus 60. As shown in FIGS. 3 and 5A-5E, shell component 90 is fitted around chamber 70 and base portion 80 in a manner that keeps chamber 70 on top of base portion 80, with shell component 90 having at least one opening that corresponds with the at least one opening 73 of chamber 70.

Turning to FIGS. 5A-5E, one embodiment of target apparatus 60 includes only a single opening for receiving a tossable object therethrough. Target apparatus 60 of FIGS. 5A-5E has a cross-sectional shape that is a square. Further, target apparatus 60 resembles a standard football end zone pylon in size and shape. As shown, this embodiment of target apparatus 60 includes shell component 90 having resealable flap 91 and sealing mechanism 93 (i.e., shown as a zipper with two zipper pulls).

Figure 5A:
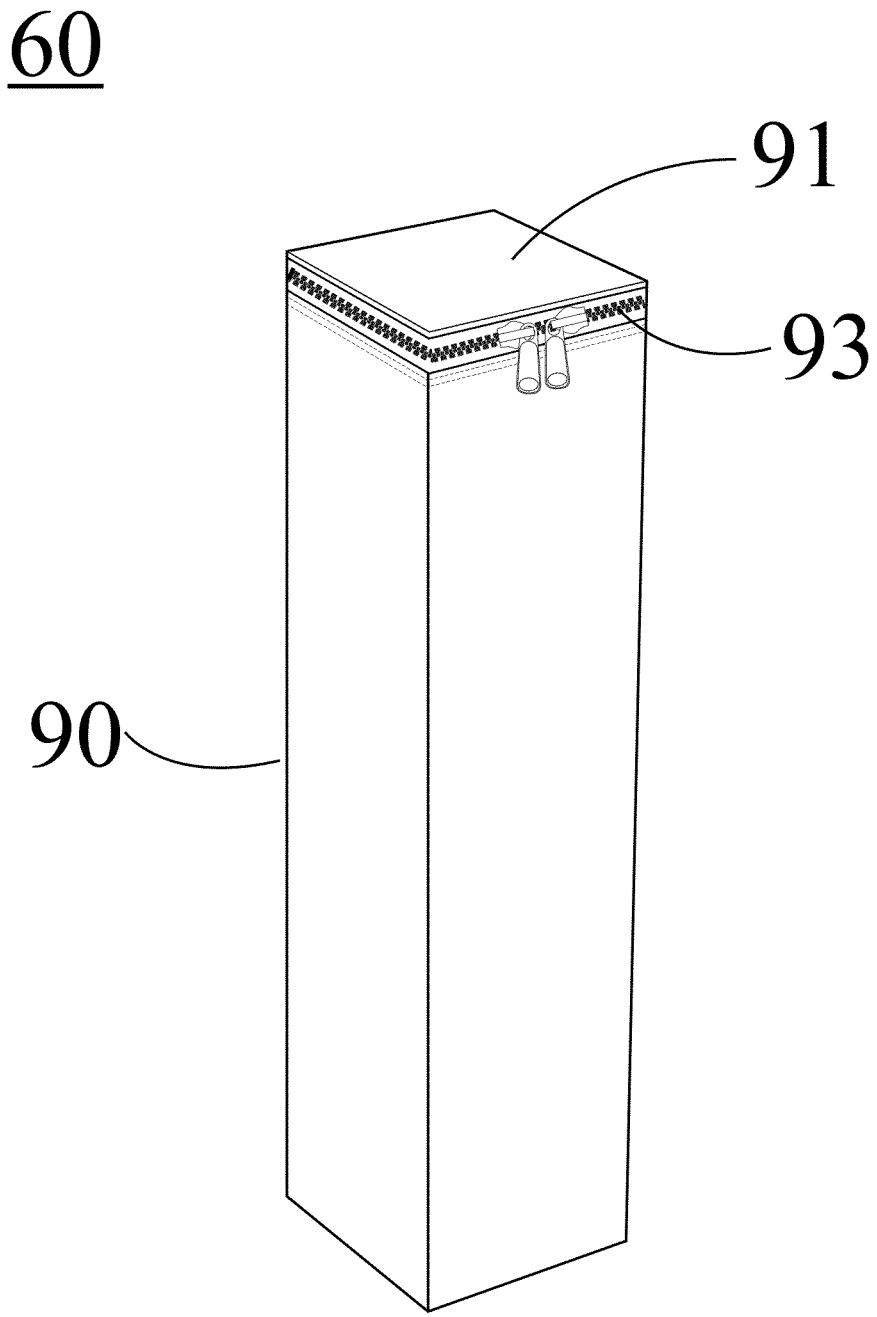
FIGS. 5A-5E are illustrations of various views of one embodiment of a target apparatus of the present invention and its component parts. The target apparatus shown in these figures is an embodiment having only one opening in the chamber and shell component for receiving a tossable object (e.g., a weighted flag), with the opening being at the top of the target apparatus.
Figure 5B:
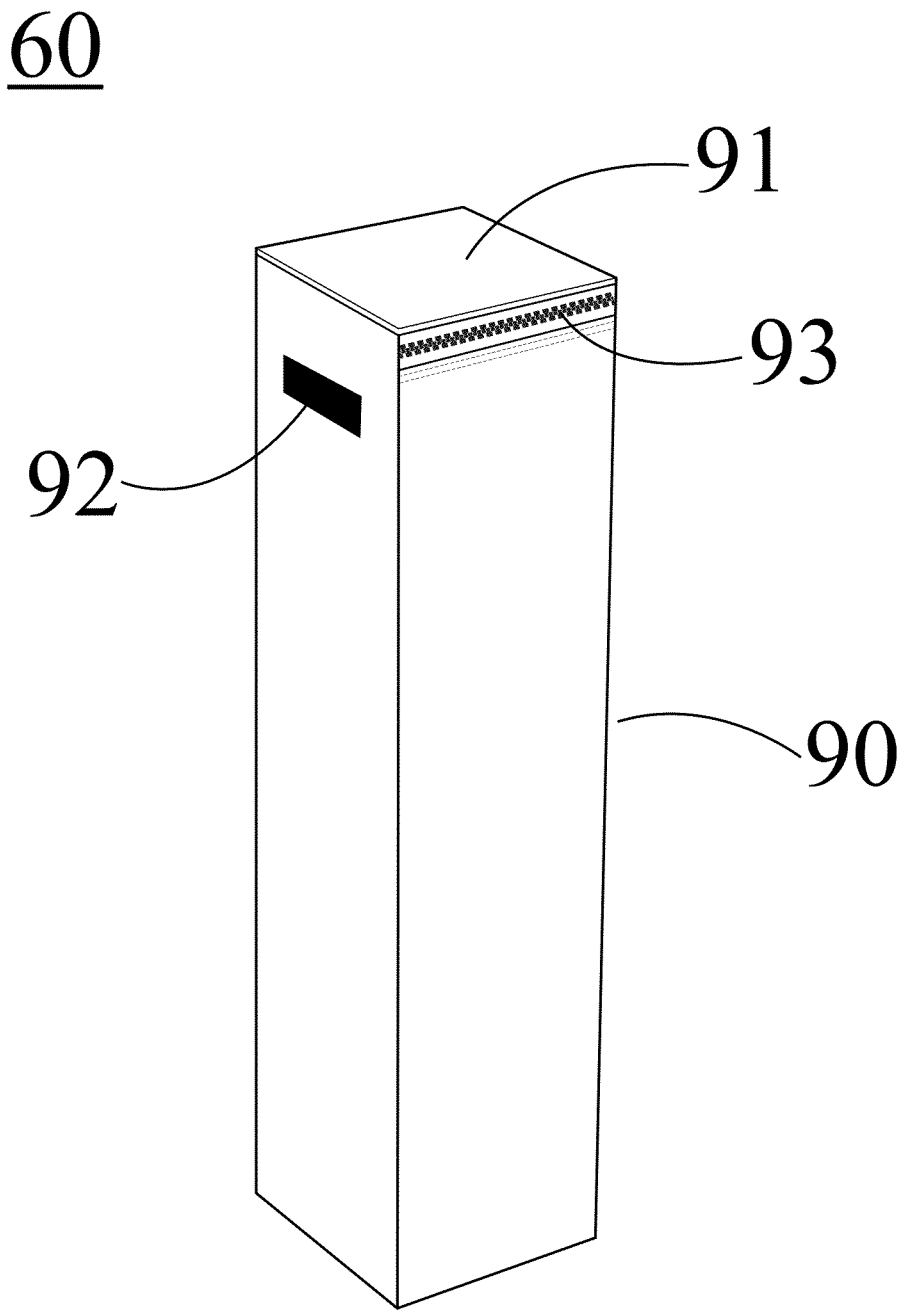
Figure 5C:
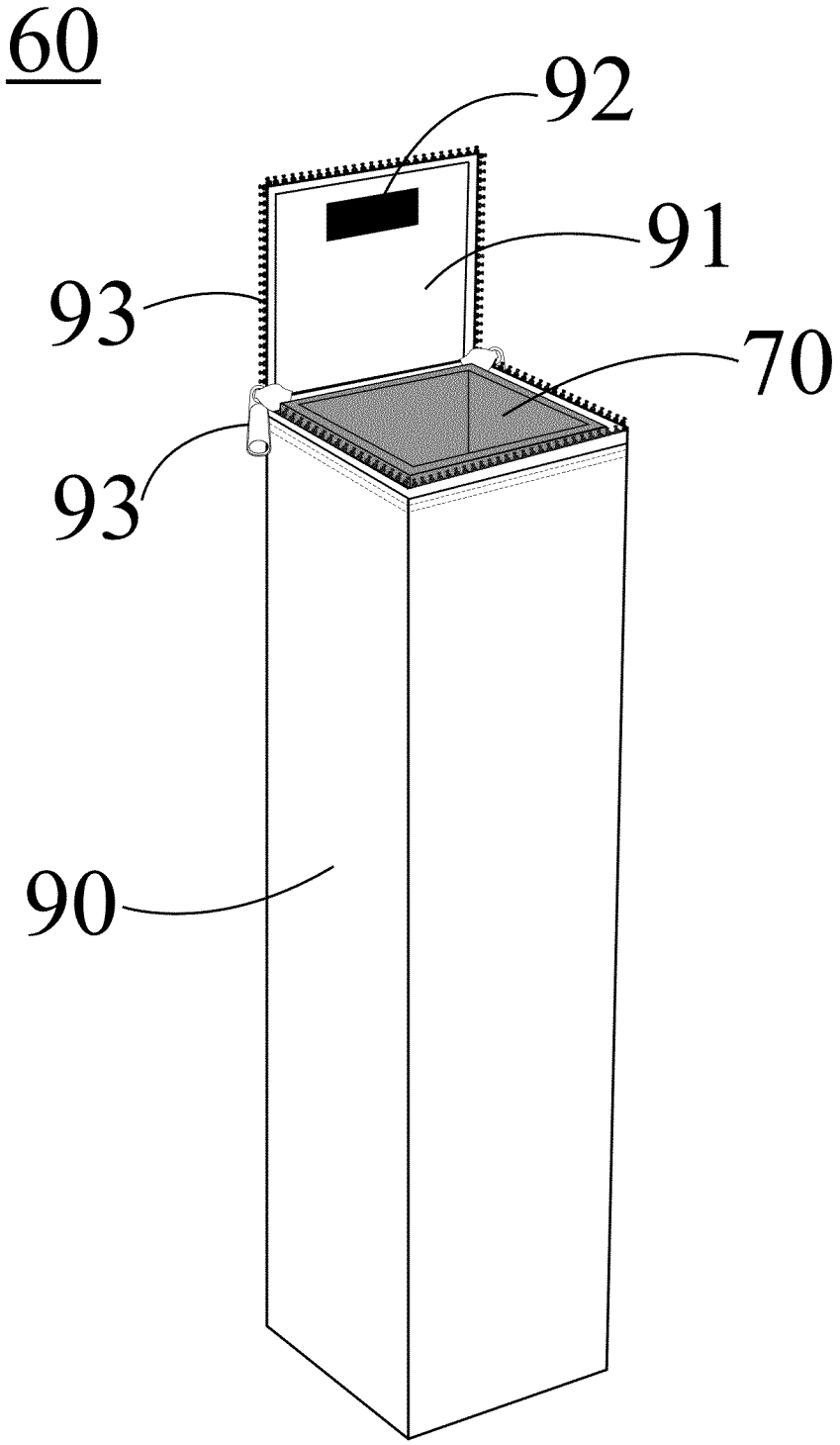
Figure 5D:
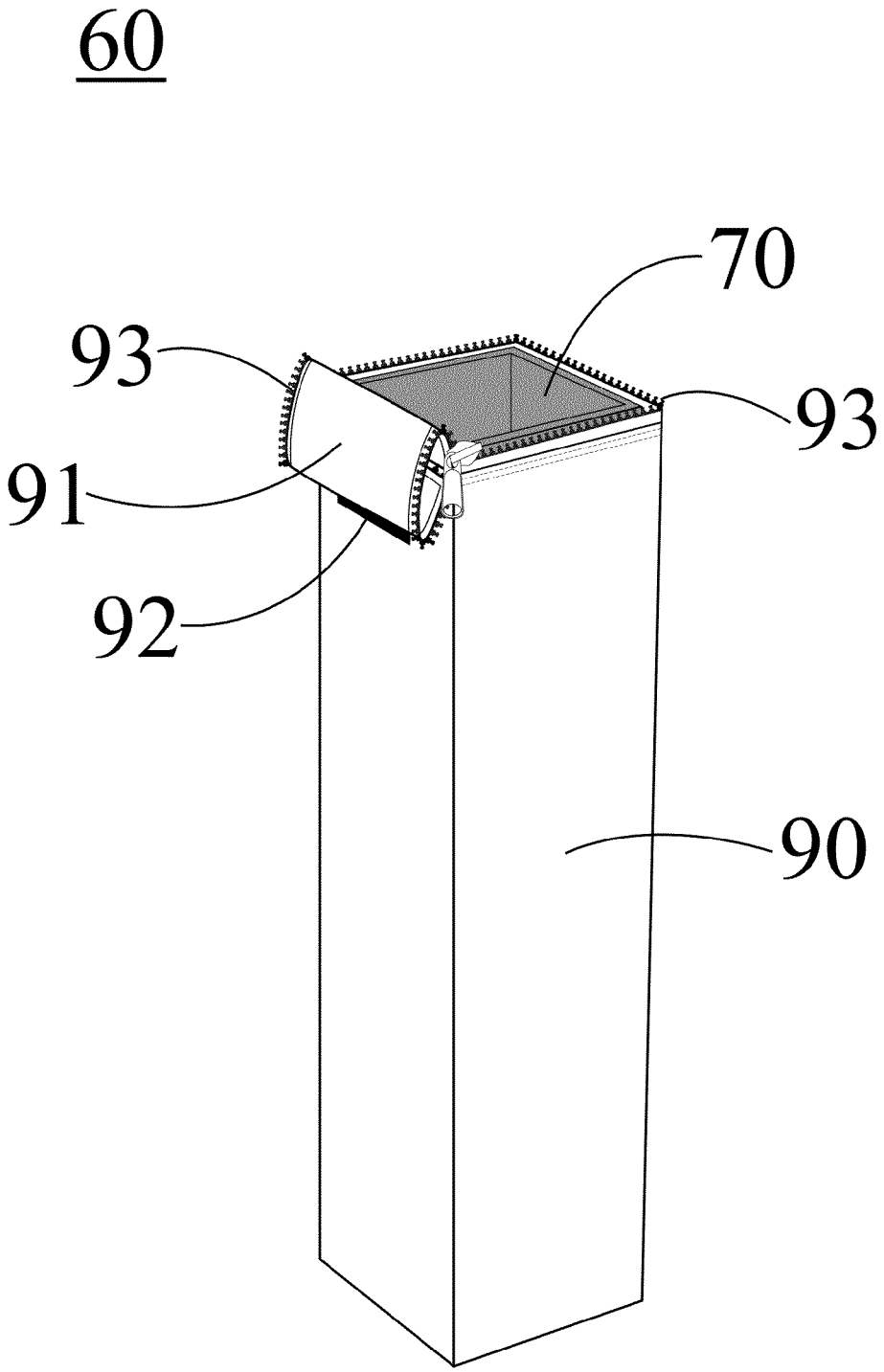
Figure 5E:
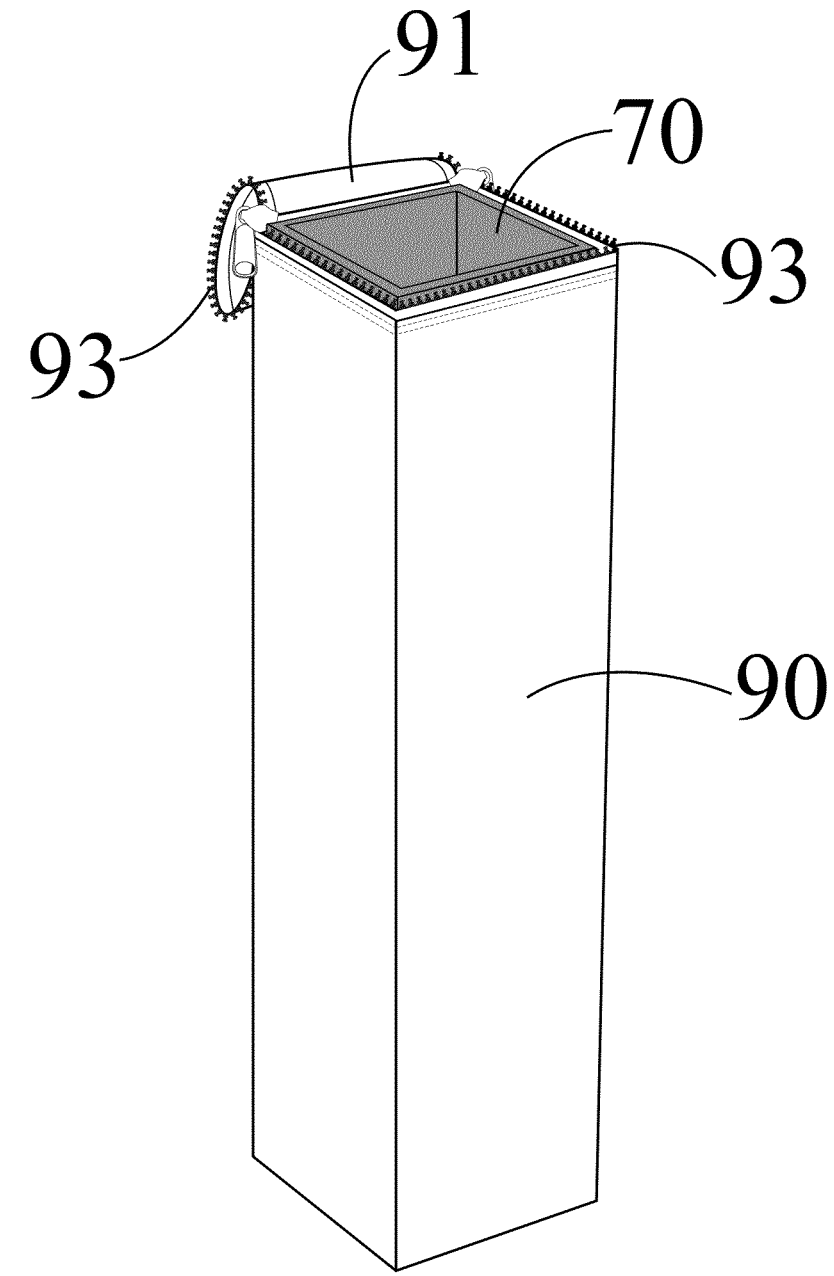

FIG. 5A shows target apparatus 60 from a substantially front view and having shell component 90 with resealable flap 91 in a closed position using sealing mechanism 93. FIG. 5B shows target apparatus 60 from a substantially rear view and having shell component 90 with resealable flap 91 in a closed position using sealing mechanism 93, and with attachment component 92 on the back side of shell component 90. FIG. 5C shows target apparatus 60 from a substantially front view and having shell component 90 with resealable flap 91 in an open position with sealing mechanism 93 disengaged, and with attachment component 92 on inside of resealable flap 91, which attaches to the resealable flap on the back side of shell component 90 (see FIG. 5B). FIG. 5D shows target apparatus 60 from a substantially rear view and having shell component 90 with resealable flap 91 in its opened and secured position by attaching complementary attachment components 92 (e.g., VELCRO®) on the inside of resealable flap 91 and on the back side of shell component 90. FIG. 5E shows target apparatus 60 from a substantially front view and having shell component 90 with resealable flap 91 in its opened and secured position by attaching complementary attachment components 92 (e.g., VELCRO®) on the inside of resealable flap 91 and on the back side of shell component 90. FIGS. 5C-5E also show chamber 70 having a single opening at its top end with shell component 90 having a complementary single opening at its top end.

Figure 6:
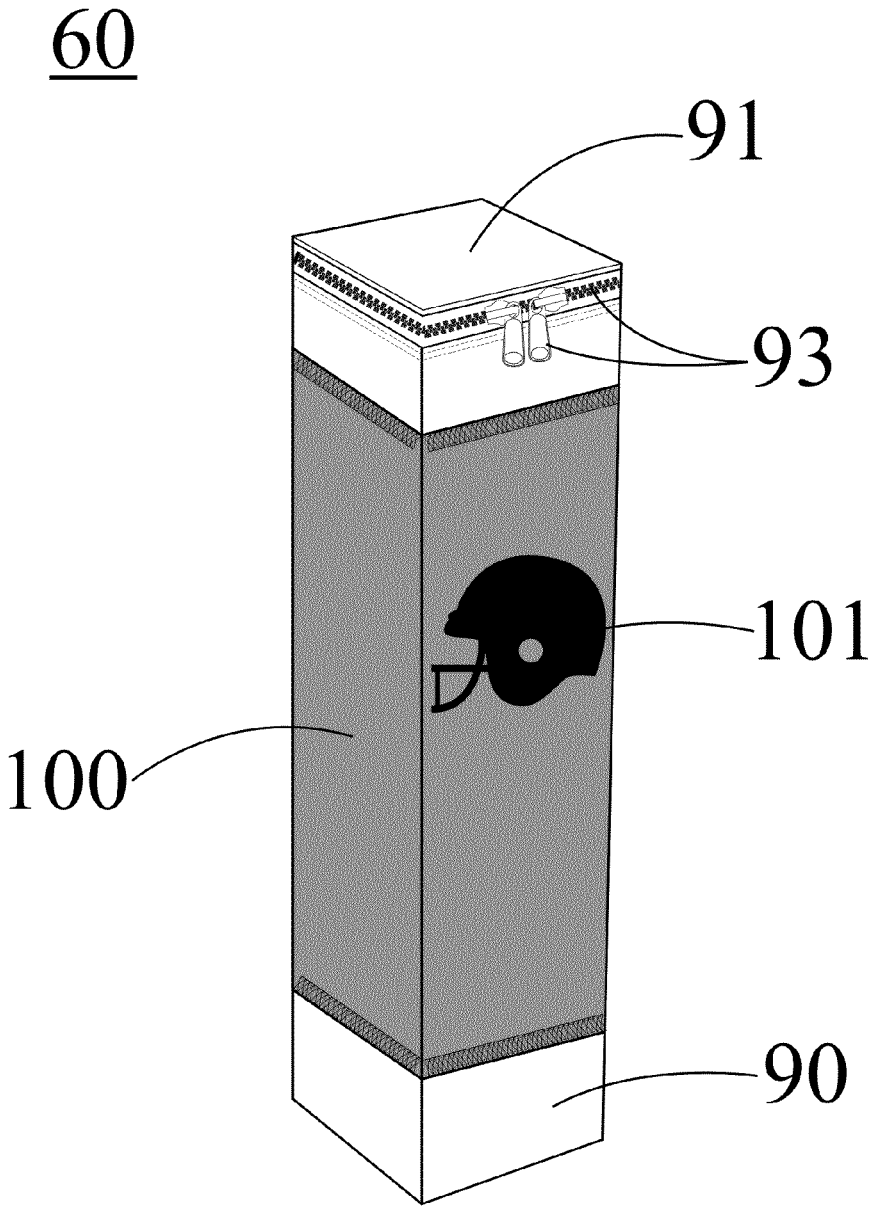
FIG. 6 is an illustration of one embodiment of a target apparatus of the present invention, with the target apparatus including a sleeve fitted around the shell component of the target apparatus.

FIG. 6 shows an embodiment of target apparatus 60 having sleeve 100 fitted around a portion of shell component 90. In this embodiment, sleeve 100 includes decorative placement 101 on one side of sleeve 100.

Figure 7A:
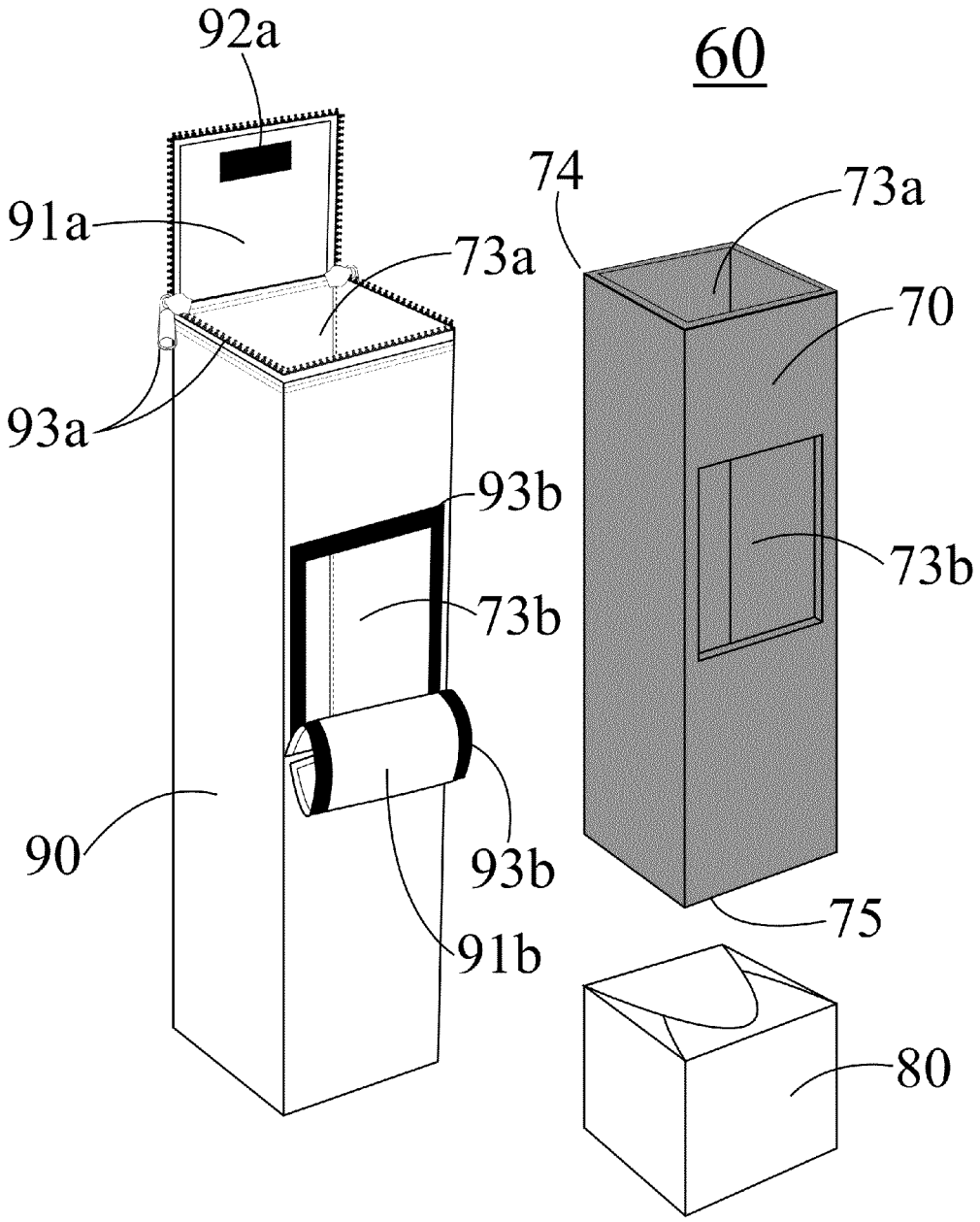
FIGS. 7A-7B are illustrations an embodiment of a target apparatus of the present invention and its component parts.
Figure 7B:
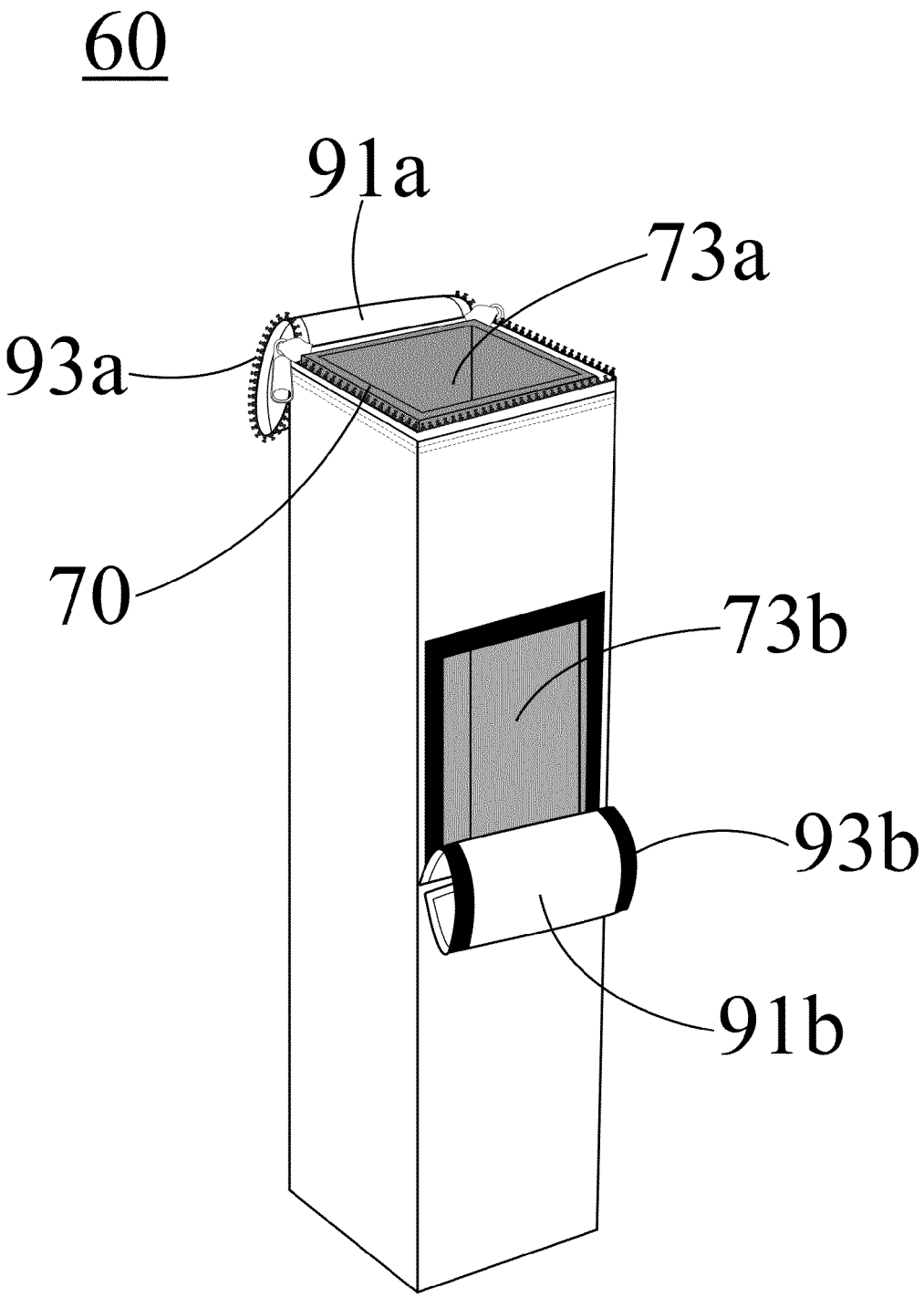

Turning to FIGS. 7A and 7B, one embodiment of target apparatus 60 includes two openings for receiving a tossable object therethrough. Target apparatus 60 of FIGS. 7A and 7B has a cross-sectional shape that is a square. Further, target apparatus 60 resembles a standard football end zone pylon in size and shape. As shown, this embodiment of target apparatus 60 includes shell component 90 having resealable flaps 91*a* and 91*b*, and sealing mechanisms 93*a* and 93*b*. Sealing mechanism 93*a* is for sealing resealable flap 91*a* (i.e., shown as a zipper with two zipper pulls) and sealing mechanism 93*b* is for sealing resealable flap 91*b* (i.e., shown as a VELCRO® attachment mechanism). FIG. 7A shows target apparatus 60 with its component parts (i.e., chamber 70, base portion 80, and shell component 90) in a disassembled state, while FIG. 7B shows target apparatus 60 with its component parts in an assembled state and ready for receiving a tossable object in both of its openings (73*a*, 73*b*).

Figure 8:
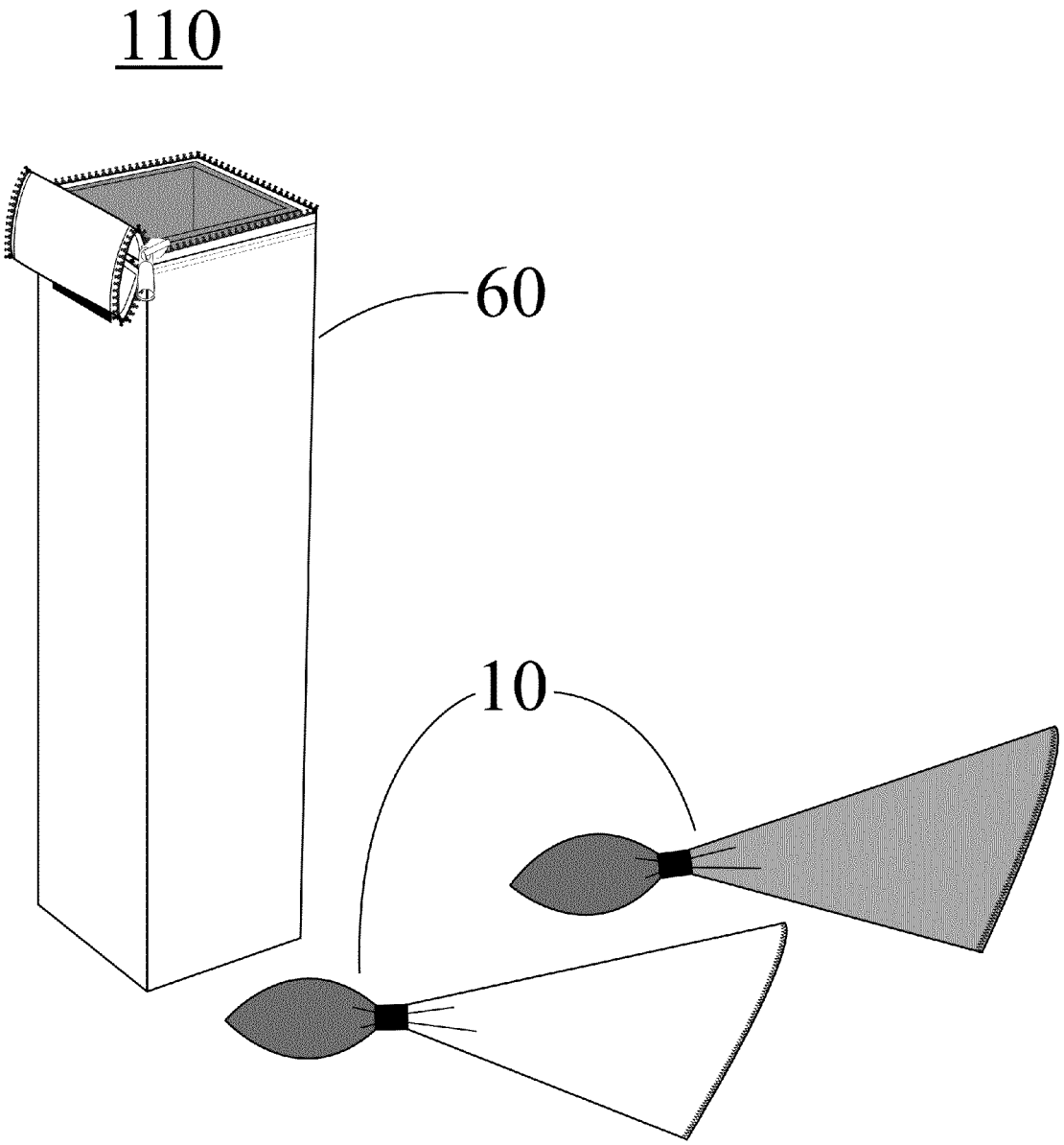
FIG. 8 is an illustration of one embodiment of a toss game set of the present invention, which includes at least one target apparatus and at least one weighted flag for each opposing player.

Turning to FIG. 8, target apparatus 60 and weighted flags 10 of the present invention can be combined to form toss game set 110. As noted herein, the toss game set of the present invention can include more than one target apparatus and more than one weighted flag (e.g., three weighted flags of one color and three weighted flags of another color), although the present invention does not limit the toss game set to a particular number of target apparatuses or weighted flags.

In one embodiment, the target apparatus of the present invention is made to resemble football end zone pylons in size, shape, and color. For example, standard football end zone pylons are approximately 18 inches high and have a square cross-sectional shape having sides that are 4 inches in length. Standard football end zone pylons are generally fluorescent orange in color. However, as noted herein, the present invention is not limited to a particular color. Provided below are steps to follow in order to make a target apparatus of the present invention that closely resembles a standard football end zone pylon in size and shape.

Step 1: Cut-out the following patterns from raw stock fabric (e.g., vinyl-coated nylon): (i) a 3-side wall piece that is 18.5 inches in height and 12.75 inches in width; (ii) a 1-side wall and base piece that is 22.75 inches in height and 4.75 inches in width; (iii) a top layer (200, FIG. 9A) of top flap that is 4.5 inches in height and 4.5 inches in width; and (iv) bottom layer (202, FIG. 9A) of top flap that is 4.5 inches in height and 4.5 inches in width. These four panels will form the target apparatus's shell component (also referred to herein as the "Outer Shell"). Gather the Other Pylon Components as listed as follows: (i) foam batting (201, FIG. 9A) for center of top flap (3.75 in.×3.75 in.×0.25 in., height×width×depth/thickness); (ii) VELCRO® strip (1 in.×2 in., height×width); (iii) zipper (203, FIG. 9A) for top flap (e.g., zipper with two pulls) (12.75 in.×1.25 in., length×width); (iv) rigid insert with hollow core (e.g., PVC) (15 in.×4 in.×4 in., height×length×width), with the top being open and the bottom being closed; and (v) gusseted plastic bag (6 in.×4 in.×4 in., height×length×width).

Step 2: After the Pylon patterns have been cut and the Other Components have been gathered, place the 3-Side Wall Piece right-side-down. Fold a ½-inch crease down from the upper edge onto the back side. Note: The term "right side" refers to the good side of the fabric that will ultimately face-out when the Pylon is complete. Using a twin needle/double stitch, sew one side of the zipper on top of this crease along the entire length of the upper edge of the fabric.

Step 3: Place the 1-Side Wall & Base Piece right-side-up and sew the loop side of the VELCRO® piece onto the fabric. The VELCRO® piece should be sewn 1¾-inches down from the upper edge of the fabric and centered on the width.

Step 4: Place the Bottom Layer (202, FIG. 9A) to the Top Flap right-side-up (the fabric face that will eventually be the bottom side of the Top Flap is facing up) and sew the hook side of the VELCRO® Piece onto the fabric. The VELCRO® Piece should be ¾ of an inch from the front edge and centered on the width.

Figure 9A:
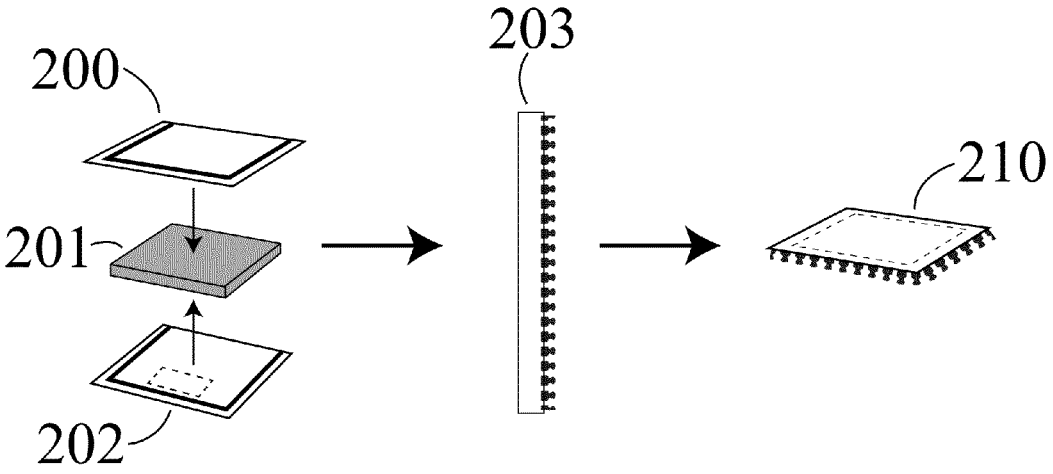
FIGS. 9A-9D are illustrations showing one embodiment of how to make a target apparatus of the present invention.

Step 5 (FIG. 9A): Create the Top Flap (210, FIG. 9A). Crease ⅜ths of an inch of fabric in toward the middle layer/Foam Batting 201 along three exposed edges (front and two sides) of both the Top Layer 200 and Bottom Layer 202 of the Pylon's Top Flap. When the layers are sewn together, this crease will neaten-up the exposed edges of the Top Flap 210 (by hiding the fabric cut lines). The bold lines represent the crease lines. They also represent the three sides of the Top Flap 210 that will have a Zipper 203. Note: The VELCRO® Piece is already sewn onto the Bottom Layer 202 (Step 4) and facing down (from this angle we can see the back side of the VELCRO'S® stitch). Sandwich the Foam Batting 201 and the other half of the Zipper 203 in between the Top Layer 200 and the Bottom Layer 202 of the Top Flap (FIG. 9A). Sew these layers together along all four edges to create the Top Flap 210. Note: One half of the zipper has already been sewn onto the Pylon Shell (Step 2). Note: The Back Edge of the Top Flap 210 has not been creased under and does not have a zipper. This edge has a ⅜ths-inch tab that will be used to attach it to the rest of the Pylon Shell.

Figure 9B:
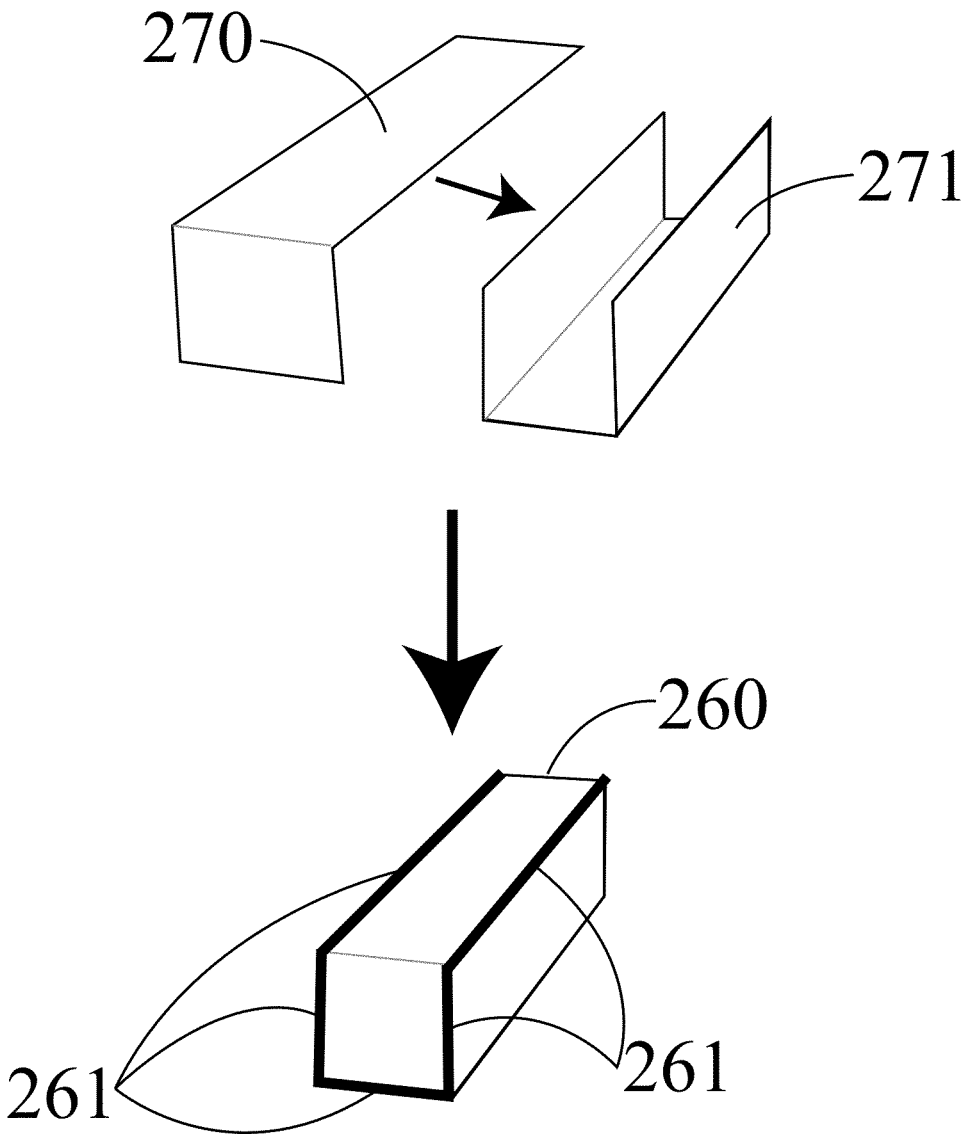

Step 6 (FIG. 9B): With right-sides-in (or with the Pylon Shell inside-out), pin the 1-Side Wall & Base Piece 270 to the 3-Side Wall Piece 271 as diagramed. The bold lines 261 represent the pinning path. Note: There will be a ½-inch tab of excess fabric where the 1-Side Wall & Base Piece 270 meets the upper edge of the Pylon Shell 260, this will be used to attach the Top Flap.

Figure 9C:
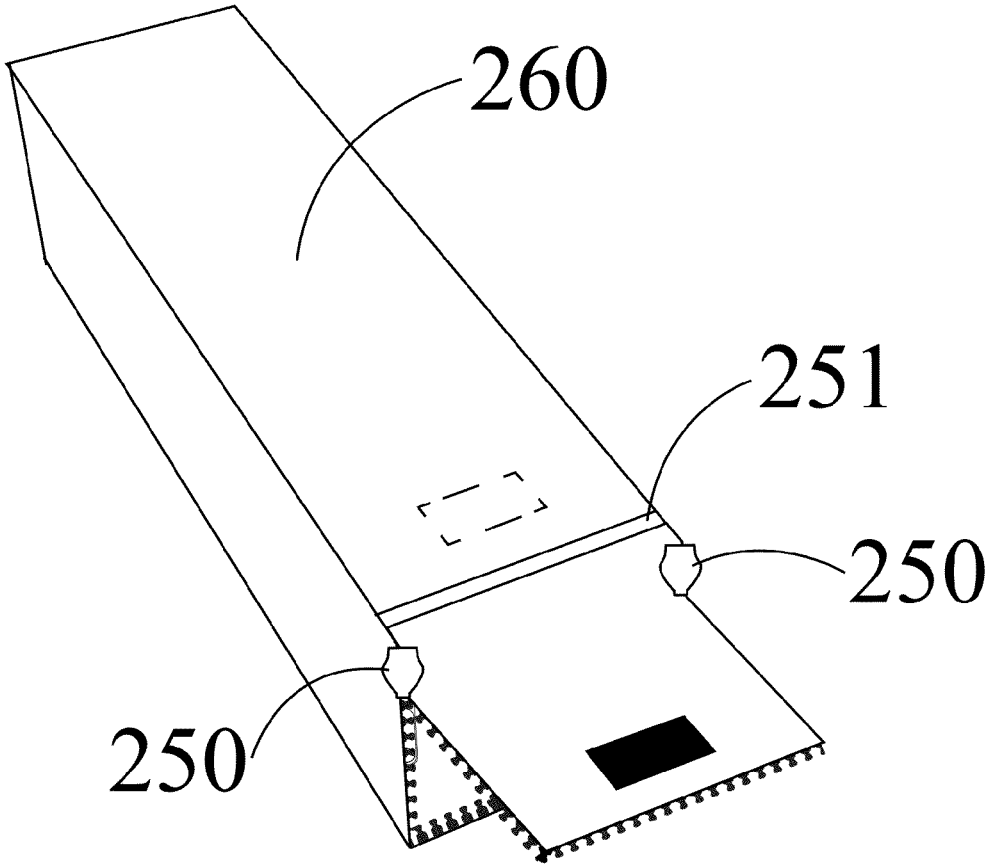

Step 7 (FIG. 9C): Prep the Top Flap to be sewn to the Pylon Shell 260. With the Top Flap right-side-down, mount the Zipper Pulls onto the Zipper Teeth Tracks. This zipping action will mount the Top Flap to the rest of the Pylon Shell and hold it in place to be sewn. Note: Pin the ½-inch tab at the top of the 1-Side Wall & Base Piece to the ⅜th-inch tab at the back edge of the Top Flap, so that they are ready to be sewn together. Shapes 250 represent the undersides of the Zipper Pulls, when mounted on the Zipper Tracks, while the Pylon Shell is inside-out. The excess tabs from the back edge of the Top Flap and the top edge of the 1-Side Wall & Base Piece overlap and are pinned here so that they are ready to be sewn together (see 251, FIG. 9C). As shown in FIG. 9C, the Pylon Shell 260 is inside-out.

Figure 9D:
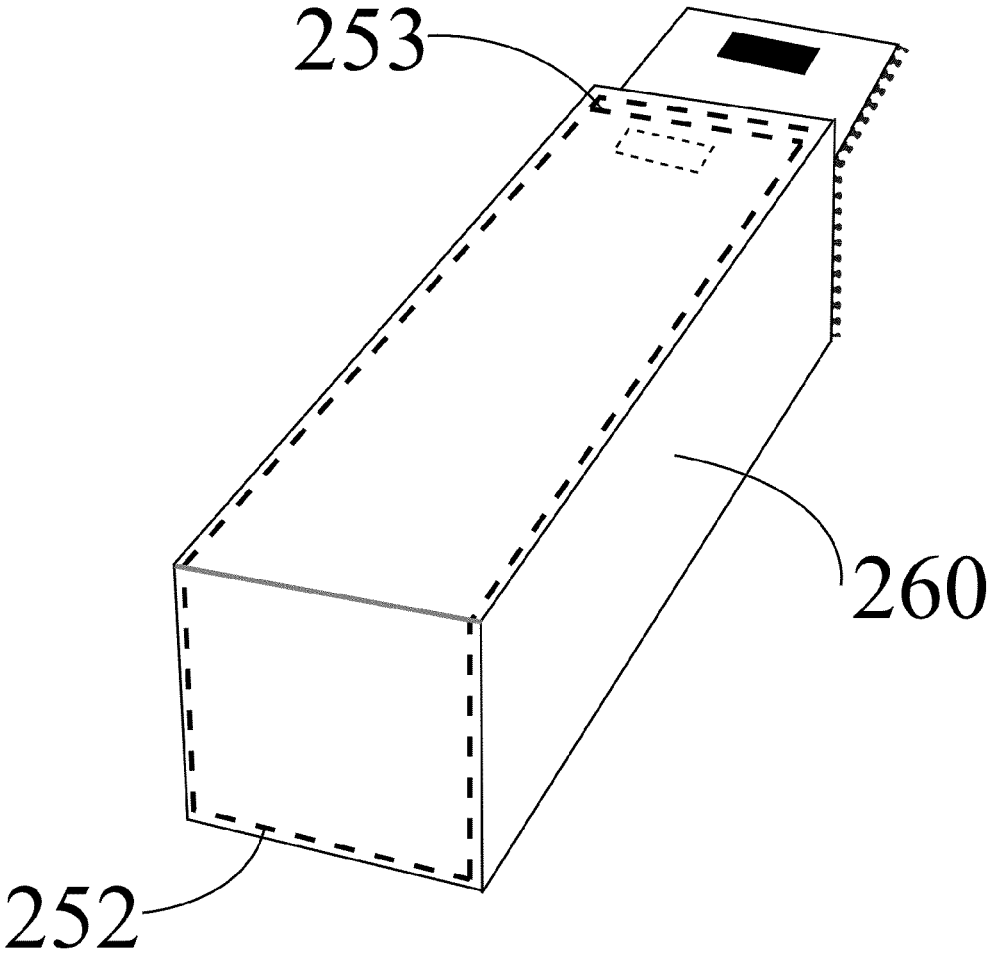

Step 8 (FIG. 9D): In one continuous stitch line 252, sew the 3-Side Wall Piece, the 1-Side Wall & Base Piece and the Top Flap together as diagramed. Add an additional stitch line 253 where the Top Flap meets the 1-Side Wall & Base Piece for reinforcement, since this hinge will get a lot of use. After this stitch, reverse the Pylon Shell 260 so that it is right-side-out. The Pylon Shell is now complete and ready to be filled. As shown in FIG. 9D, the Pylon Shell is inside-out.

Step 9: Form the Pylon's Weighted Base by filling the Gusseted Plastic Bag 3-inches high with loose fill sand (this is approximately 3 pounds of sand). Fold the top of the bag down and tape it shut, forming a 4-inch by 4-inch cube sand bag that is 3-inches tall.

Step 10: Place the Weighted Base into the Pylon Shell. Then Place the Rigid Insert with Hollow Core into the Pylon Shell. Zipper the Top Flap shut and the Flagger Game Pylon is complete and ready for use.

In another embodiment, the target apparatus of the present invention can be made according to the following non-limiting example. Patterns are cut from a roll of raw stock fabric (e.g. vinyl-coated nylon fabric). Print is applied to the fabric (e.g. logos and designs). The fabric patterns are sewn together to form the pylon's Outer Shell with Top Flap and Seal Mechanism (e.g. a zipper). This piece of the Storage Pylon resembles a hollow fabric case. A weighted material (e.g. sand) is placed into a container (e.g. a gusseted plastic bag) and sealed (e.g. with a plastic slide lock or with tape) to form the pylon's Weighted Base. The square tubes that form the Rigid Insert with Hollow Core are made by molding plastic (e.g. polyvinyl chloride/PVC). For the two-piece version of the Rigid Insert, a Square Tube is combined with a Base Cap. The Square Tube can be made by extrusion or injection molding the plastic. The Base Cap can be made by injection molding. Once the two pieces are molded, the Base Cap is secured (e.g. by pressure mount or glue) onto one side of the Square Tube to form the completed Rigid Insert with Hollow Core. Notes: A one-piece Rigid Insert with Hollow Core can also be made by injection molding the Square Tube with one end open and one end shut. The preferred embodiment of the Rigid Insert with Hollow Core is made out of plastic, but softer versions can be made out of either rubber or foam. Once the above components are made, the Outer Shell with Top Flap is filled with the Weighted Base. It is subsequently filled with the Rigid Insert with Hollow Core. The Top Flap is sealed shut (e.g. zippered) and the Storage Pylon is complete.

In another aspect, the present invention provides a toss game set comprising: (i) at least one weighted flag according to the present invention; and (ii) at least one target apparatus according to the present invention. As shown in FIG. 8, in one embodiment, the toss game set includes at least one weighted flag of a first color and at least one weighted flag of a second color, the first color corresponding to a first player or team and the second color corresponding to an opposing second player or team. In another embodiment, the toss game set includes two or more targets.

In yet another aspect, the present invention provides a method of play for a weighted flag toss game. This method involves the steps of: (i) providing to at least one player a weighted flag and at least one target for the weighted flag; (ii) tossing of the weighted flag by the at least one player at the target for the purpose executing a scoring action, where the value of the scoring action is based on proximity of the tossed weighted flag, after coming to a resting state, in relation to the target or in relation to a designated area in, on, or nearby the target; and (iii) determining a total value of scoring actions for the at least one player, where the total value of scoring actions is calculated by adding the value of cumulative scoring actions for the at least one player. As used herein, the term "proximity," as it refers to the value of the scoring action, can include placement of the tossable object (e.g., the weighted flag) in, on, or nearby the target. For example, as used herein, the term "proximity" is meant to include, without limitation, a scoring action where the tossable object lands inside of the target (e.g., the weighted flag travels into the opening of a target and lands inside of that target), sticks to the target or to a portion of the target, rests on the target or on a portion of the target, or lands nearby the target or nearby a portion of the target.

In one embodiment, the providing step of the method of play includes providing a toss game set that includes: (a) at least one weighted flag for use as an aerodynamic projectile directed to the at least one target, with the at least one weighted flag having (i) a head portion including a pouch containing a weighted, granular material, the head portion having a front end and a back end and (ii) a tail portion attached to and extending from the back end of the head portion, with the tail portion having a substantially cone-shaped pocket having a tapered tip end and an opposing flared end, the tapered tip end being attached to the back end of the head portion; and (b) at least one target at which the at least one weighted flag is to be tossed as an object for playing the corresponding toss game, the at least one target including an apparatus for receiving and storing a tossable object, the apparatus including (i) a chamber having a rigid or semi-rigid sidewall component forming a hollow core and having at least one opening for receiving a tossable object therethrough, the chamber having a top end and a bottom end; (ii) a base portion disposed below the bottom end of the chamber for the purpose of maintaining the chamber in a substantially upright orientation, the base portion being configured to house a weighted material for stabilizing the apparatus; and (iii) a shell component fitted around the chamber and the base portion in a manner that keeps the chamber on top of the base portion, the shell component having at least one opening that corresponds with the at least one opening of the chamber.

FLAGGER™ Brand Toss Game Rules of Play

As provided herein, the weighted flags, target apparatuses, and toss game sets of the present invention can be used in a toss game. FLAGGER™ brand toss game is a non-limiting example of a toss game for use with the weighted flags, target apparatuses, and toss game sets of the present invention. Provided below are examples of rules of play of various embodiments of a FLAGGER™ brand toss game that corresponds to an embodiment of the method of play of the present invention.

A. Two Player Rules

Unzip the pylons and remove flags. VELCRO® the pylon's top flap open. Set the pylons 10 yards apart (which is about 10 large strides apart). Note: The distance between pylons can be increased or decreased based upon a player's skill level or the dimensions of the space available to play. Grab three flags per player. Both players stand behind pylon #1 and take turns tossing one flag at a time at pylon #2. The object of the game is to land your flags as close as possible to, or into, the target pylon. Notes: Players can choose who leads-off in the first round, but the player with the most total points leads-off in the follow-up rounds. Flags can be thrown using any style imaginable, but the recommended throwing style is to grab the end of the flag's tail and toss it underhand. If a flag is thrown while a player's foot is in front of the pylon it is a foot foul. A foot foul throw does not count and it cannot be re-thrown. After all flags have been tossed, walk to pylon #2 and score the round according to the "Scoring the Game" section of these rules. After scoring is complete, both players grab their flags, stand behind pylon #2 and play toward pylon #1.

B. Four Player Rules

In four player games, divide into two teams of two players each. Place one player from each team at pylon #1 and one player from each team at pylon #2. Use the same game play rules and flags as in a two player game, but rather than walking back-and-forth from pylon-to-pylon, one set of players always throws in one direction (from pylon #1 toward pylon #2) and the other set of players always throws in the other direction (from pylon #2 toward pylon #1).

C. Scoring the Game

Scoring is based upon the position of the flag's head; the position of the flag's tail does not count. Games are played to 21 points, but speed games can be played to 14 or whatever point value is agreed upon by the players. All games must be won by 2 points. 1 point: Given to any flags that are closer to the pylon than your opponent's closest flag. 7 points: Given to any flag heads that are resting directly on the pylon. These are called "Resters" or "Touchdowns."

D. Down-the-Chute or a FLAGGER™ Shot

If a player tosses a flag down the pylon's hollow core, this is called a "Down-the-Chute" shot or a "FLAGGER™" shot. The player that throws a Down-the-Chute shot automatically wins the game unless their opponent can also throw a Down-the-Chute shot on their next throw, called a "Chute Save" or a "FLAGGER™ Save". If a Chute Save occurs, the Down-the-Chute flags are considered Push Flags and no points are awarded for the round. Note: A Chute Save shot is only allowed if the player attempting a Chute Save has a flag left to throw in that round. Therefore, if a Down-the-Chute shot happens on the last flag throw of a round, it is an automatic victory and cannot be Chute Saved.

E. General Scoring Notes

Push Flags:

If two opposing flags are equidistant from the pylon, or both touching the pylon, or both Down-the-Chute, they are considered "Push Flags" and no point values are assigned. If Push Flags are the closest flags to the pylon in the round, the round ends with no points scored. If the Push Flags are not the closest flags to the pylon in the round, points are awarded to the closest flags, but no points can be earned by the Push Flags.

Short-Course Scoring:

For a short-course game, set the pylons 5 yards apart (which is about 5 large strides apart). In short-course games, award 1 point to any flags that are closer to the pylon than your opponent's closest flag, 3 points to Resters/Touchdowns and 7 points to Down-the-Chute/FLAGGER™ shots.

F. Special Circumstances

A Downed Pylon:

If a pylon is knocked over by a flag, then a flag's scoring position is judged based on its proximity to any portion of the downed pylon. If a flag goes Down-the-Chute and the pylon is knocked over, the shot counts as a Down-the-Chute shot as long as the flag head remains fully within the pylon's chute after it falls over. Note: A Chute Save shot is still allowed in this instance, but it may be unlikely/impossible because the pylons tend to topple with their openings pointing away from the throwing side.

As set forth herein, embodiments of the present invention discussed herein have been described by way of example in this specification. Having thus described the basic concept of the invention, it will be rather apparent to those of ordinary skill in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and the scope of the invention. Additionally, the recited order of processing elements or sequences, or the use of numbers, letters, or other designations therefore, is not intended to limit the claimed processes to any order, except as may be specified in the claims. Accordingly, the invention is limited only by the following claims and equivalents thereto.

What is claimed is:

1. A toss game set comprising:

at least one weighted flag for use as an aerodynamic projectile directed to a target, said weighted flag comprising:

(i) a head portion comprising a pouch containing a weighted, granular material, said head portion having a front end and a back end; and (ii) a tail portion attached to and extending from the back end of the head portion, said tail portion comprising a substantially cone-shaped pocket having a tapered tip end and an opposing flared end, said tapered tip end being attached to the back end of the head portion; and at least one target at which the at least one weighted flag is to be tossed as an object for playing the corresponding toss game, said at least one target comprising an apparatus for receiving and storing a tossable object, said apparatus comprising:

(i) a chamber comprising a rigid or semi-rigid sidewall component forming a hollow core and having at least one opening for receiving a tossable object therethrough, said chamber having a top end and a bottom end;

(ii) a base portion disposed below the bottom end of the chamber for the purpose of maintaining the chamber in a substantially upright orientation, said base portion being configured to house a weighted material for stabilizing the apparatus; and (iii) a shell component fitted around the chamber and the base portion in a manner that keeps the chamber on top of the base portion, said shell component having at least one opening that corresponds with the at least one opening of the chamber.

2. The toss game set according to claim 1, wherein the chamber of the target apparatus comprises a cross-sectional shape and dimensions that are maintained from the top end to the bottom end of the chamber.

3. The toss game set according to claim 2, wherein the cross-sectional shape is selected from the group consisting of a square, a rectangle, a triangle, a circle, an oval, and a star.

4. The toss game set according to claim 1, wherein the shell component of the target apparatus includes a resealable flap covering the at least one opening of the chamber.

5. The toss game set according to claim 4, wherein the shell component includes an attachment component for holding the resealable flap away from the at least one opening of the chamber and from the corresponding at least one opening of the shell component.

6. The toss game set according to claim 1, wherein the toss game set comprises at least one weighted flag of a first color and at least one weighted flag of a second color, the first color corresponding to a first player or team and the second color corresponding to an opposing second player or team.

7. The toss game set according to claim 1, wherein the toss game set comprises two or more targets.

8. The toss game set according to claim 1, wherein the head portion of the weighted flag has a form selected from the group consisting of a prolate spheroid, a sphere, a spheroid, an ovoid, a cone, a pyramid, a three-dimensional triangle, and a cube.

9. The toss game set according to claim 1, wherein the head portion of the weighted flag is made from a material selected from the group consisting of microfiber, nylon, polyester, olefin, cotton, hemp, leather, suede, synthetic leather, synthetic suede, rubber, rubber-coated fabrics, vinyl-coated fabrics, ripstop fabrics, ballistic fabrics, fiberglass fabrics, lyocell, and denim.

10. The toss game set according to claim 1, wherein the tail portion of the weighted flag is made from a material selected from the group consisting of lightweight ripstop fabric, nylon, polyester, microfiber, cotton, linen, hemp, bamboo, taffeta, silk, synthetic silk, rayon, spandex, lyocell, and olefin.

11. The toss game set according to claim 1, wherein the head portion and the tail portion of the weighted flag are made from the same or different materials.

12. The toss game set according to claim 1, wherein the flared end of the tail portion of the weighted flag is opened, sealed, partially sealed, or sealable.

13. The toss game set according to claim 1, wherein the weighted, granular material of the weighted flag is selected from the group consisting of sand, dirt, plastic pellets, metallic pellets, rubber pellets, seeds, beans, grains, kernels, hulls, pebbles, beads, and mixtures thereof.

14. The toss game set according to claim 1 further comprising:

a securing component for preventing or inhibiting the weighted, granular material contained in the head portion of the weighted flag from migrating into the tapered tip of the tail portion of the weighted flag.

15. The toss game set according to claim 1 further comprising:

a neckband for covering a region where the head portion and tail portion of the weighted flag attach to one another.

16. The toss game set according to claim 1, wherein the at least one opening of the target apparatus is positioned at the top end of the rigid or semi-rigid chamber or on the sidewall component of the chamber.

17. The toss game set according to claim 1, wherein the chamber of the target apparatus has multiple openings for receiving the tossable object, said multiple openings being positioned on the top end and at least at one side of the sidewall component of the chamber, or being positioned on more than one side of the sidewall component.

18. The toss game set according to claim 1, wherein the chamber of the target apparatus is made from a rigid or semi-rigid material selected from the group consisting of plastic (e.g., polyvinyl chloride (PVC)), rubber, metal, cardboard, wood, foam, and inflatable fabric.

19. The toss game set according to claim 1, wherein the base portion of the target apparatus is configured to house a weighted material selected from the group consisting of sand, dirt, pebbles, beads, plastic, rubber, metal, water, concrete, seeds, beans, grains, kernels, hulls, and mixtures thereof.

20. The toss game set according to claim 1, wherein the base portion of the target apparatus has a cross-sectional shape that is the same or different from the cross-sectional shape of the chamber.

21. The toss game set according to claim 1, wherein the shell component of the target apparatus is made from a formable material selected from the group consisting of vinyl-coated fabrics (e.g. vinyl-coated nylon), vinyl, microfiber, nylon, polyester, olefin, cotton, hemp, leather, suede, synthetic leather, synthetic suede, rubber, rubber-coated fabrics, ripstop fabrics, ballistic fabrics, fiberglass fabrics, lyocell, denim, plastic, wood, and metal.

22. The toss game set according to claim 1 further comprising a sleeve fitted around at least a portion of the shell component of the target apparatus, wherein said sleeve either includes or does not include at least one opening that corresponds with the at least one opening of the shell component, said sleeve having a decorative placement thereon or effective to receive a decorative placement thereon.

23. The toss game set according to claim 1, wherein said apparatus is configured to resemble a football end zone pylon in form and dimension.

24. A method of play for a weighted flag toss game, said method comprising the steps of:

providing to at least one player a toss game set according to claim 1;

tossing of the weighted flag by the at least one player at the target for the purpose of executing a scoring action, wherein the value of the scoring action is based on proximity of the tossed weighted flag, after coming to a resting state, in relation to the target or in relation to a designated area in, on, or nearby the target; and determining a total value of scoring actions for the at least one player, wherein the total value of scoring actions is calculated by adding the value of cumulative scoring actions for the at least one player.

25. A toss game set comprising:

at least one weighted flag for use as an aerodynamic projectile directed to a target, said weighted flag comprising:

(i) a head portion comprising a pouch containing a weighted, granular material, said head portion having a front end and a back end; and (ii) a tail portion attached to and extending from the back end of the head portion, said tail portion comprising a substantially cone-shaped pocket having a tapered tip end and an opposing flared end, said tapered tip end being attached to the back end of the head portion; and at least one target at which the at least one weighted flag is to be tossed as an object for playing the corresponding toss game.

26. The toss game set according to claim 25, wherein the toss game set comprises at least one weighted flag of a first color and at least one weighted flag of a second color, the first color corresponding to a first player or team and the second color corresponding to an opposing second player or team.

27. The toss game set according to claim 25, wherein the toss game set comprises two or more targets.

28. The toss game set according to claim 25, wherein the head portion of the weight flag has a form selected from the group consisting of a prolate spheroid, a sphere, a spheroid, an ovoid, a cone, a pyramid, a three-dimensional triangle, and a cube.

29. The toss game set according to claim 25, wherein the head portion of the weight flag is made from a material selected from the group consisting of microfiber, nylon, polyester, olefin, cotton, hemp, leather, suede, synthetic leather, synthetic suede, rubber, rubber-coated fabrics, vinyl-coated fabrics, ripstop fabrics, ballistic fabrics, fiberglass fabrics, lyocell, and denim.

30. The toss game set according to claim 25, wherein the tail portion of the weight flag is made from a material selected from the group consisting of lightweight ripstop fabric, nylon, polyester, microfiber, cotton, linen, hemp, bamboo, taffeta, silk, synthetic silk, rayon, spandex, lyocell, and olefin.

31. The toss game set according to claim 25, wherein the head portion and the tail portion of the weight flag are made from the same or different materials.

32. The toss game set according to claim 25, wherein the flared end of the tail portion of the weight flag is opened, sealed, partially sealed, or sealable.

33. The toss game set according to claim 25, wherein the weighted, granular material of the weight flag is selected from the group consisting of sand, dirt, plastic pellets, metallic pellets, rubber pellets, seeds, beans, grains, kernels, hulls, pebbles, beads, and mixtures thereof.

34. The toss game set according to claim 25 further comprising:

a securing component for preventing or inhibiting the weighted, granular material contained in the head portion of the weight flag from migrating into the tapered tip of the tail portion.

35. The toss game set according to claim 25 further comprising:

a neckband for covering a region where the head portion and tail portion of the weight flag attach to one another.

36. A method of play for a weighted flag toss game, said method comprising the steps of:

providing to at least one player a toss game set according to claim 25;

tossing of the weighted flag by the at least one player at the target for the purpose of executing a scoring action, wherein the value of the scoring action is based on proximity of the tossed weighted flag, after coming to a resting state, in relation to the target or in relation to a designated area in, on, or nearby the target; and determining a total value of scoring actions for the at least one player, wherein the total value of scoring actions is calculated by adding the value of cumulative scoring actions for the at least one player.

* * * * *